US012264542B2

(12) United States Patent
Rivera, Jr. et al.

(10) Patent No.: US 12,264,542 B2
(45) Date of Patent: Apr. 1, 2025

(54) FIXED CUTTER DRILL BITS AND CUTTER ELEMENT ARRANGEMENTS FOR SAME

(71) Applicant: National Oilwell DHT, L.P., Conroe, TX (US)

(72) Inventors: Richard Rivera, Jr., Conroe, TX (US); Robert Peter Douglas Tipples, Cheltenham (GB)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 290 days.

(21) Appl. No.: 17/816,639

(22) Filed: Aug. 1, 2022

(65) Prior Publication Data

US 2023/0038632 A1 Feb. 9, 2023

Related U.S. Application Data

(60) Provisional application No. 63/229,010, filed on Aug. 3, 2021.

(51) Int. Cl.
*E21B 10/43* (2006.01)
*E21B 10/56* (2006.01)

(52) U.S. Cl.
CPC ..... *E21B 10/43* (2013.01); *E21B 10/56* (2013.01)

(58) Field of Classification Search
CPC ..... E21B 10/5673
See application file for complete search history.

(56) References Cited

U.S. PATENT DOCUMENTS 5,549,171 A 8/1996 Mensa-Wilmot et al.
6,164,394 A 12/2000 Mensa-Wilmot et al.
(Continued)

FOREIGN PATENT DOCUMENTS

EP 1288432 A1 3/2003

OTHER PUBLICATIONS

PCT/US2022/074232 International Search Report and Written Opinion dated Nov. 8, 2022 (15 p.).

*Primary Examiner* — Cathleen R Hutchins
(74) *Attorney, Agent, or Firm* — CONLEY ROSE, P.C.

(57) ABSTRACT

A drill bit for drilling a borehole in an earthen formation has a central axis and a cutting direction of rotation. The bit includes a bit body configured to rotate about the axis in the cutting direction of rotation. The bit body includes a bit face. The bit also includes a blade extending radially along the bit face. In addition, the bit includes a first cutter element mounted to a cutter-supporting surface of the blade and a second cutter element mounted to the cutter-supporting surface of the blade. The first cutter element has a central axis and includes a first forward-facing cutting face including a first cutting tip distal the cutter supporting surface and a first planar surface extending radially from the first cutting tip toward the central axis of the first cutter element. The first planar surface is oriented at a first effective backrake angle measured between the cutter supporting surface and a surface vector of the first planar surface. The second cutter element has a central axis and comprises a second forward-facing cutting face including a second cutting tip distal the cutter supporting surface and a second planar surface extending radially from the second cutting tip toward the central axis of the second cutter element. The second planar surface is oriented at a second effective backrake angle measured between the cutter supporting surface and a surface vector of the second planar surface. The second effective backrake angle is greater than the first effective backrake angle.

43 Claims, 13 Drawing Sheets

(56) References Cited

U.S. PATENT DOCUMENTS

| | | | | |
|---|---|---|---|---|
| 6,536,543 | B2 * | 3/2003 | Meiners | E21B 10/55 175/336 |
| 2013/0112485 | A1 * | 5/2013 | Richert | E21B 10/02 175/428 |
| 2016/0032657 | A1 * | 2/2016 | Zhang | E21B 10/5735 175/430 |
| 2018/0291690 | A1 * | 10/2018 | Rahmani | E21B 10/5673 |
| 2019/0106943 | A1 | 4/2019 | Tilleman et al. | |
| 2020/0149352 | A1 | 5/2020 | Silveus, III et al. | |

* cited by examiner

FIXED CUTTER DRILL BITS AND CUTTER ELEMENT ARRANGEMENTS FOR SAME

CROSS-REFERENCE TO RELATED APPLICATIONS

This application claims benefit of U.S. provisional patent application Ser. No. 63/229,010 filed Aug. 3, 2021, and entitled "Fixed Cutter Drill Bits and Cutter Element Arrangements for Same," which is hereby incorporated herein by reference in its entirety.

STATEMENT REGARDING FEDERALLY SPONSORED RESEARCH OR DEVELOPMENT

Not applicable.

BACKGROUND

The present disclosure relates generally to earth-boring bits used to drill a borehole for the ultimate recovery of oil, gas or minerals. More particularly, the disclosure relates to fixed cutter drill bits with improved cutter element arrangements. Still more particularly, the disclosure relates to fixed cutter drill bits including cutter elements with cutting face geometries defining different effective backrake angles.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill wellbores. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The drilling fluid exiting the face of the bit through nozzles or ports performs several functions. In particular, the fluid removes formation cuttings (e.g., rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life.

BRIEF SUMMARY OF THE DISCLOSURE

Embodiments of drill bits for drilling a borehole in an earthen formation are disclosed herein. In one embodiment, a drill bit has a central axis and a cutting direction of rotation. The bit comprises a bit body configured to rotate about the axis in the cutting direction of rotation. The bit body includes a bit face. The bit also comprises a blade extending radially along the bit face. In addition, the bit comprises a first cutter element mounted to a cutter-supporting surface of the blade and a second cutter element mounted to the cutter-supporting surface of the blade. The first cutter element has a central axis and comprises a first forward-facing cutting face including a first cutting tip distal the cutter supporting surface and a first planar surface extending radially from the first cutting tip toward the central axis of the first cutter element. The first planar surface is oriented at a first effective backrake angle measured between the cutter supporting surface and a surface vector of the first planar surface. The second cutter element has a central axis and comprises a second forward-facing cutting face including a second cutting tip distal the cutter supporting surface and a second planar surface extending radially from the second cutting tip toward the central axis of the second cutter element. The second planar surface is oriented at a second effective backrake angle measured between the cutter supporting surface and a surface vector of the second planar surface. The second effective backrake angle is greater than the first effective backrake angle.

In another embodiment, a drill bit for drilling a borehole in an earthen formation has a central axis and a cutting direction of rotation. The bit comprises a bit body configured to rotate about the axis in the cutting direction of rotation. The bit body includes a bit face. The bit also comprises a first blade extending radially along the bit face. In addition, the bit comprises a second blade extending radially along the bit face and circumferentially-spaced from the first blade. Further, the bit comprises a first cutter element mounted to a cutter-supporting surface of the first blade and a second cutter element mounted to a cutter-supporting surface of the second blade. The first cutter element has a central axis and comprises a first forward-facing cutting face including a first cutting tip distal the cutter supporting surface of the first blade and a first planar surface extending radially from the first cutting tip toward the central axis of the first cutter element. The first planar surface is oriented at a first effective backrake angle measured between the cutter supporting surface of the first blade and a surface vector of the first planar surface. The second cutter element has a central axis and comprises a second forward-facing cutting face including a second cutting tip distal the cutter supporting surface of the second blade and a second planar surface extending radially from the second cutting tip toward the central axis of the second cutter element. The second planar surface is oriented at a second effective backrake angle measured between the cutter supporting surface of the second blade and a surface vector of the second planar surface. The second effective backrake angle is greater than the first effective backrake angle.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
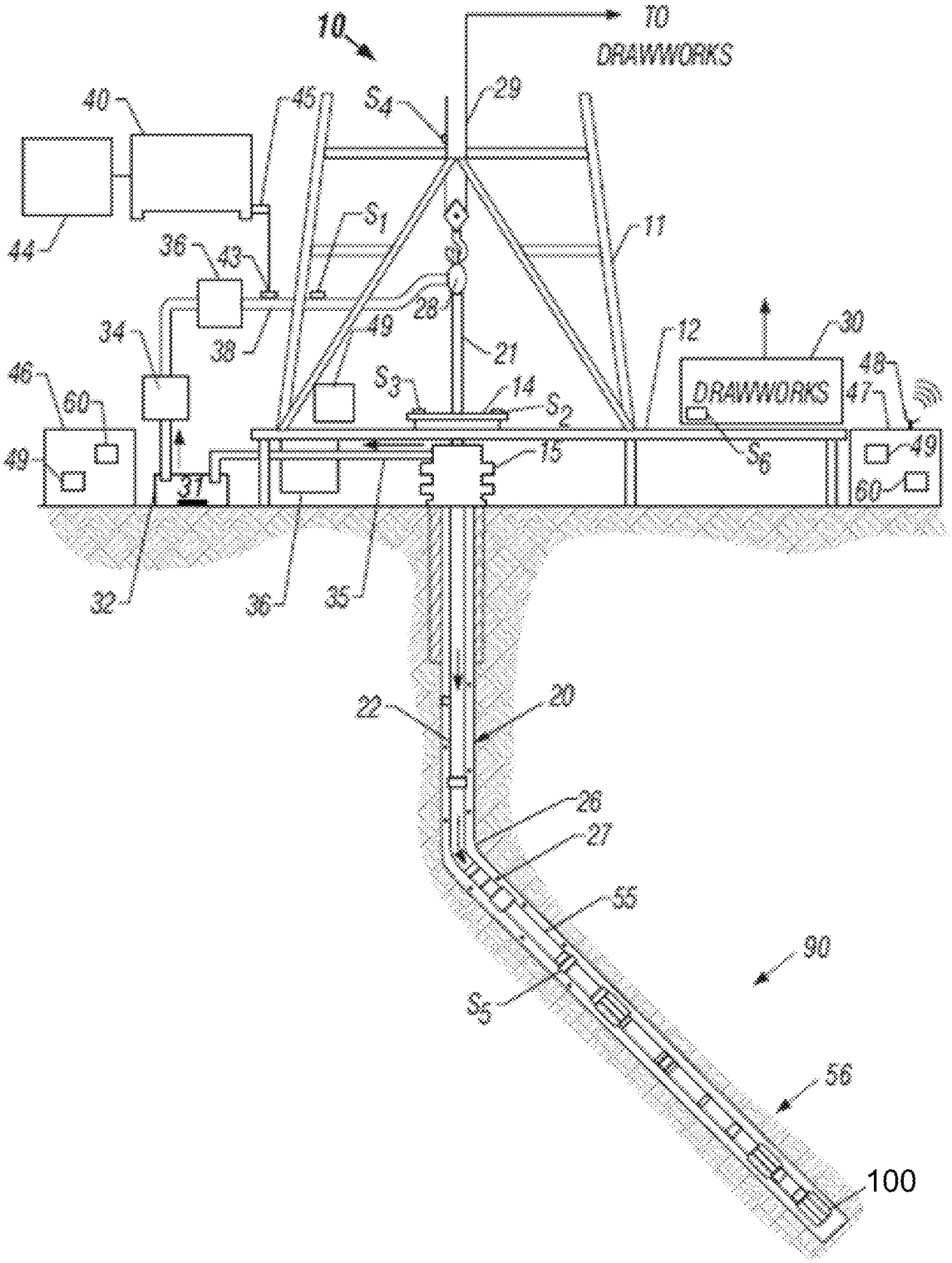
FIG. 1 is a schematic view of a drilling system including an embodiment of a drill bit in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is desirable to employ drill bits which will drill faster and longer.

The length of time that a drill bit may be employed before it must be changed depends upon a variety of factors. These factors include the bit's rate of penetration ("ROP"), as well as its durability or ability to maintain a high or acceptable ROP. One factor that significantly affects bit ROP and durability is the vibrational response of the bit during drilling. More specifically, torsional vibrations experienced by a fixed cutter bit (i.e., when the instantaneous angular speed of the drill bit oscillates about that of the drive system) can negatively impact performance of the drill bit. Torsional vibrations may be particularly problematic when drilling heterogeneous formations that frequently change in composition as the drill bit advances. Accordingly, embodiments of drill bits described herein and the associated arrangement of cutter elements offer the potential to reduce torsional vibrations during drilling while maintaining suitable ROP.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
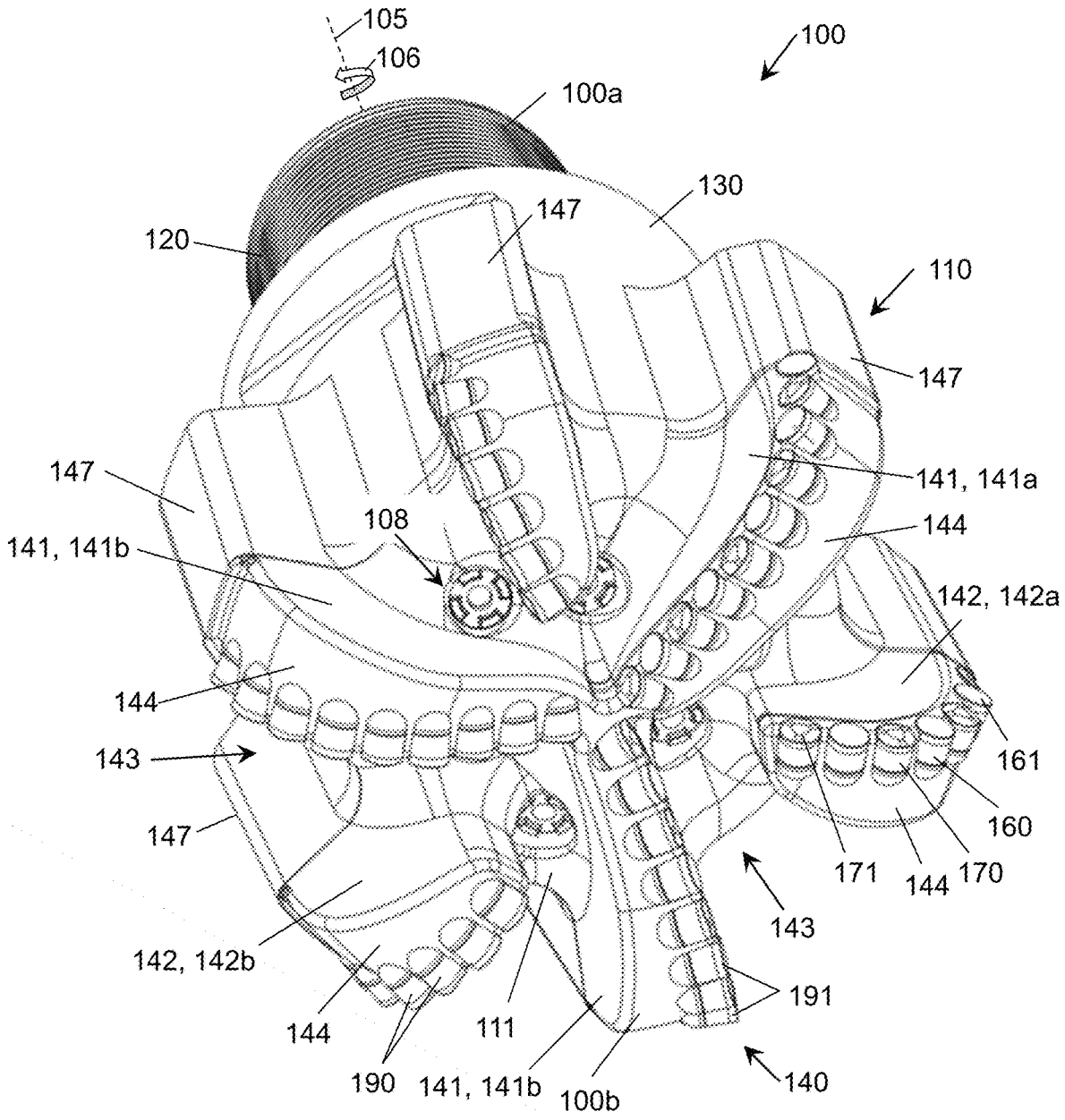
FIG. 2 is a perspective view of the drill bit of FIG. 1.
Figure 3:
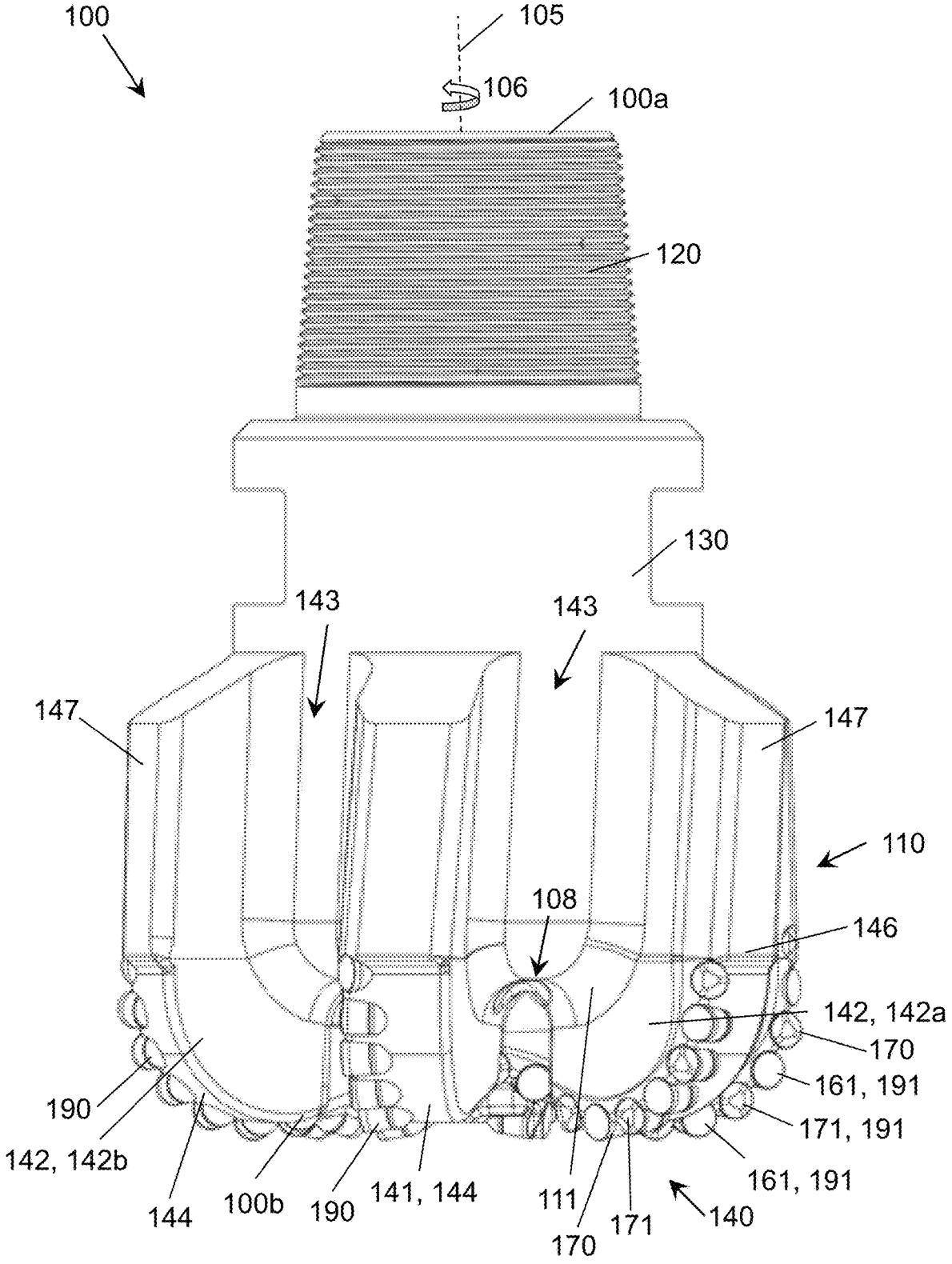
FIG. 3 is a side view of the drill bit of FIG. 2.
Figure 4:
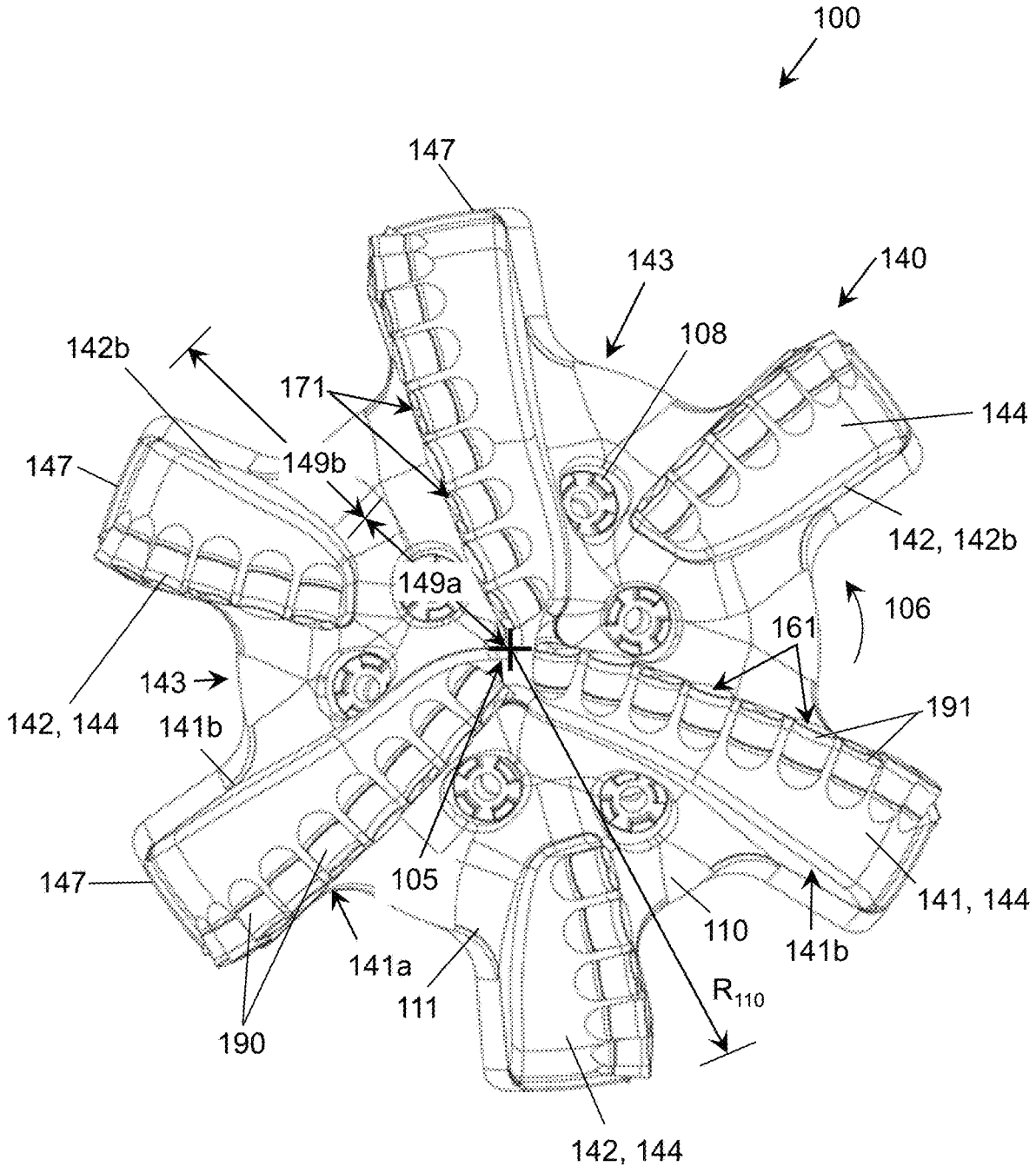
FIG. 4 is an end view of the drill bit of FIG. 2.

Referring now to FIGS. 2-4, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to a drill string (not shown), which is employed to rotate the bit in order to drill the borehole. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades which extend from bit face 111. As best shown in FIGS. 2 and 4, in this embodiment, cutting structure 140 includes three angularly spaced-apart primary blades 141 and three angularly spaced apart secondary blades 142. Further, in this embodiment, the plurality of blades (e.g., primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

In this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2-4, each blade 141, 142 includes a cutter-supporting surface 144 that generally faces the formation during drilling and extends circumferentially from the leading side 141*a* to the trailing side 142 of the corresponding blade 141, 142. In this embodiment, a plurality of cutter elements 160, 170 are fixably mounted to cutter supporting surface 144 of each blade 141, 142. Cutter elements 160, 170 are generally arranged adjacent one another in a radially extending row proximal the leading edge 141*a* of each primary blade 141 and each secondary blade 142. In this embodiment, cutter elements 160, 170 are arranged in an alternating fashion along moving radially outward along each blade 141, 142. However, in other embodiments, the cutter elements (e.g., cutter elements 160, 170) may be arranged differently.

Each cutter element 160, 170 comprises an elongated and generally cylindrical support member or substrate 190 and a cylindrical disk or tablet-shaped, hard cutting layer 191 of polycrystalline diamond or other superabrasive material is bonded to the exposed end of the support member 190. The support member 190 is received and secured in a pocket formed in cutter supporting surface 144 of the corresponding blade 141, 142 to which it is fixed. The cylindrical disc, hard cutting layer 191 defines a cutting face 161, 171 of the corresponding cutter element 160, 170, respectively. As will be described in more detail below, in this embodiment, each cutting face 161 is entirely and completely planar, whereas each cutting face 171 is not completely planar, but rather, includes a plurality of planar surfaces or facets that intersect at distinct edges along the cutting face 171. As used herein, the phrase "non-planar" may be used to refer to a cutting face that includes one or more curved surfaces (e.g., concave surface(s), convex surface(s), or combinations thereof) and/or a plurality of distinct planar surfaces that intersect at distinct edges along the cutting face. Accordingly, cutting face 171 may also be referred to herein as non-planar cutting face 171.

In the embodiments described herein, each cutter element 160, 170 is mounted such that its cutting face 161, 171, respectively, is generally forward-facing. As used herein, "forward-facing" is used to describe the orientation of a cutting face such that each surface on the cutting face is substantially perpendicular to or at an acute angle relative to the cutting direction of the bit (e.g., cutting direction 106 of bit 100).

Referring still to FIGS. 2-4, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 160, 170 wear slightly under gage. Gage pads 147 also help stabilize bit 100 against vibration.

Figure 5:
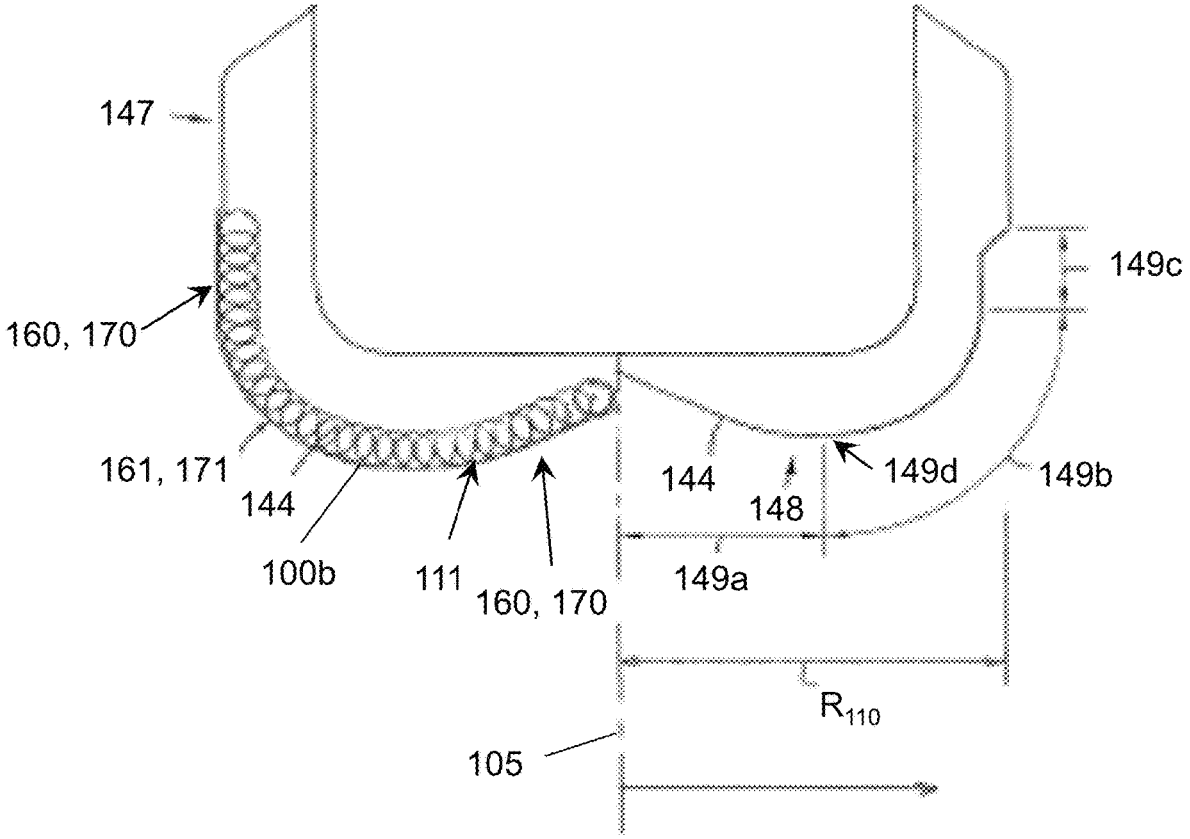
FIG. 5 is a partial cross-sectional schematic view of the bit shown in FIG. 2 with the blades and the cutting faces of the cutter elements rotated into a single composite profile.

Referring now to FIG. 5, an exemplary profile of blades 141, 142 is shown as it would appear with blades 141, 142 and cutting faces 161, 171 rotated into a single rotated profile. In rotated profile view, blades 141, 142 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* is the radially innermost region of bit body 110 and composite blade profile 148 that extends from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, referred herein to as the nose 149*d*, occurs at the axially outermost portion of composite blade profile 148 where a tangent line to the blade profile 148 has a slope of zero. Moving radially outward, adjacent shoulder region 149*b* is the gage region 149*c*, which extends substantially parallel to bit axis 105 at the outer radial periphery of composite blade profile 148. As shown in composite blade profile 148, gage pads 147 define the gage region 149*c* and the outer radius Rio of bit body 110. Outer radius $R_{110}$ extends to and therefore defines the full gage diameter of bit 100.

Referring briefly to FIG. 4, moving radially outward from bit axis 105, bit 100 and bit face 111 include cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (e.g., primary blades 141, secondary blades, 142, etc.), and cutter elements (e.g., cutter elements 160, 170) are possible.

Bit 100 includes an internal plenum extending axially from uphole end 100*a* through pin 120 and shank 130 into bit body 110. Plenum permits drilling fluid to flow from the drill string into bit 100. Body 110 is also provided with a plurality of flow passages extending from the plenum to downhole end 100*b*. As best shown in FIGS. 2-4, a nozzle 108 is seated in the lower end of each flow passage. Together, the plenum, passages, and nozzles 108 serve to distribute drilling fluid around cutting structure 140 to flush away formation cuttings and to remove heat from cutting structure 140, and more particularly cutter elements 160, 170, during drilling.

Figure 6:
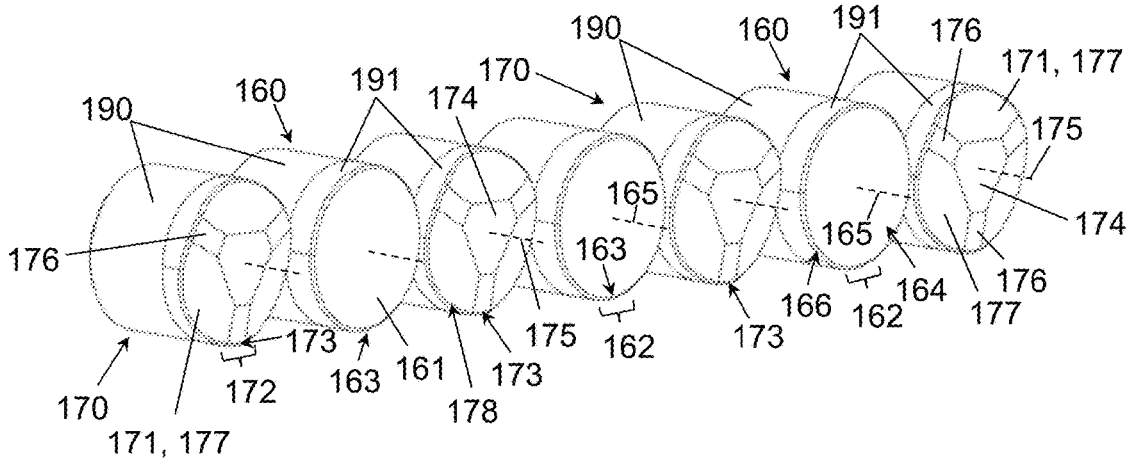
FIG. 6 is a perspective front view of a portion of a row of cutter elements on one of the blades of the drill bit of FIG. 2.

Referring now to FIG. 6, a portion of an exemplary row of cutter elements 160, 170 on one primary blade 141 is shown. For purposes of clarity, the corresponding primary blade 141 is not shown in FIG. 6, however, it is to be understood that cutter elements 160, 170 are shown in FIG. 6 with their lower portions adjacent the formation being drilled and the remainder of drill bit 100 positioned above cutter elements 160, 170. As previously described, on each blade 141, 142, cutter elements 160, 170 are arranged in a row in an alternating fashion such that two cutter elements 160 are not positioned radially adjacent one another on a given blade 141, 142, and two cutter elements 170 are not positioned radially adjacent one another on a given blade 141, 142. Stated differently, one cutter element 160 is radially positioned between each pair of radially adjacent cutter elements 170 on the same blade 141, 142, and one cutter element 170 is radially positioned between each pair of radially adjacent cutter elements 160 on the same blade 141, 142.

Each cutting face 161, 171 includes a cutting edge 162, 172, respectively, distal the corresponding cutter supporting surface 144. Cutting edges 162, 172 are configured to positively engage, penetrate, and remove formation material via a shearing action. In this embodiment, each cutting edge 162, 172 is chamfered or beveled. Each cutting face 161, 171 also includes a cutting tip 163, 173, respectively, that is disposed along the cutting edge 162, 172, respectively, and defines an extension height of the corresponding cutter element 160, 170, respectively. As used herein and generally known in the art, the phrase "extension height" refers to the maximum distance or height to which a structure (e.g., cutting face 161, 171) extends measured perpendicularly from the cutter-supporting surface of the blade to which it is mounted. Thus, tip 163, 173 of each cutter element 160, 170, respectively, defines the point on the corresponding cutting face 161, 171, respectively, that is furthest from the cutter supporting surface 144 of the corresponding blade 141, 142 as measured perpendicular to the corresponding cutter supporting surface. Each cutting tip 163, 173 also defines the radial position of the corresponding cutter element 160, 170, respectively. Referring briefly to FIG. 4, as used herein, the term "radial position" of a cutter element or a cutting face is defined by the radial distance measured perpendicularly from the bit axis to the cutting tip of the cutting face of the cutter element. Thus, each cutter element 160, 170 and corresponding cutting face 161, 171 has a radial position defined by the radial distance measured perpendicularly from the bit axis 105 to the corresponding cutting tip 163, 173. In this embodiment, each cutter element 160, 170 on drill bit 100 has a unique radial position, and thus, each cutting tip 163, 173 is disposed at a unique and different radial distance measured perpendicularly from the bit axis 105 to the cutting tip 163, 173. It should be appreciated that cutter elements 160, 170 with sequentially adjacent radial positions may be disposed on different blades 141, 142.

Referring again to FIG. 6, as described above, cutting faces 161 are completely planar, whereas non-planar cutting faces 171 are not completely planar. In this embodiment, each cutting face 161 is the same and each cutting face 171 is the same. Thus, one cutting face 161 will be described it being understood that the other cutting faces 161 are the same, and one cutting face 171 will be described it being understood that each cutting face 171 is the same.

Cutter element 160 has a central or longitudinal axis 165, which is generally defined by the coaxially aligned central axes of substrate 190 and cutting layer 191 of cutter element 160. Cutting face 161 comprises a planar surface 164 oriented perpendicular to axis 165 and extending radially from central axis 165 to the outer periphery of cutting face 161. A chamfer 166 extends circumferentially about cutting face 161 and layer 191, and extends axially from cutting face 161. In other words, chamber 166 intersects the radially outer edge of cutting face 161. As previously described, in this embodiment, the entire cutting face 161 is defined by planar surface 164. Thus, planar surface 164 extends radially from cutting edge 162 and cutting tip 163 to central axis 165 regardless of the rotational orientation of cutter element 160 with respect to central axis 165.

Figure 8:
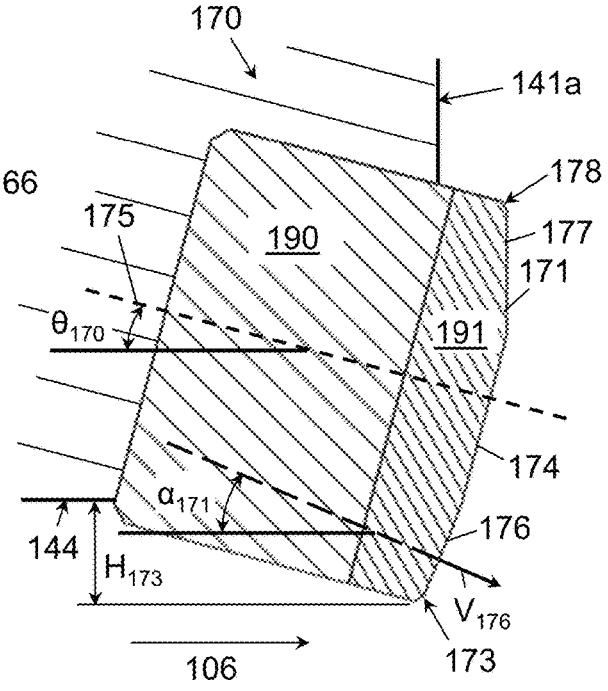
FIG. 8 is a cross-sectional side view of one of the cutter elements of FIG. 6.

Cutter element 170 has a central or longitudinal axis 175, which is generally defined by the coaxially aligned central axes of substrate 190 and cutting layer 191 of cutter element 170. Non-planar cutting face 171 is generally convex or bowed outward as shown in FIG. 8. In this embodiment, non-planar cutting face 171 is defined by a plurality of discrete regions or surfaces that intersect at linear boundaries or edges. More specifically, non-planar cutting face 171 includes a central region or surface 174, a plurality of uniformly circumferentially-spaced a cutting regions or surfaces 176 extending radially from central region 174 to the radially outer periphery of cutting face 171, and a plurality of uniformly circumferentially-spaced relief regions or surfaces 177 extending from central region 174 and cutting surfaces 176 to the radially outer periphery of cutting face 171. A chamfer 178 extends circumferentially about cutting face 171 and layer 191, and extends axially from cutting face 171. In other words, chamfer 178 intersects surfaces 176, 177 along the radially outer edge of cutting face 171. Surfaces 176, 177 are circumferentially disposed about axis 175 and central surface 174. In addition, surfaces 176, 177 are arranged in a circumferentially alternating manner such that surfaces 176, 177 are positioned circumferentially adjacent each other with each surface 176 circumferentially disposed between a pair of circumferentially-adjacent surfaces 177, and each surface 177 circumferentially disposed between a pair of circumferentially-adjacent surfaces 176. Consequently, the number of cutting surfaces 176 and the number of relief surfaces 177 is the same. In this embodiment, non-planar cutting face 171 includes three cutting surfaces 176 and three relief surfaces 177. However, in other embodiments, more than three cutting surfaces (e.g., surfaces 176) and more than three relief surfaces (e.g., surfaces 177) may be provided it being understood that the number of cutting surfaces and relief surfaces is the same (e.g., five cutting surfaces and five relief surfaces, six cutting surfaces and six relief surfaces, etc.). As non-planar cutting face 171 includes three uniformly circumferentially spaced cutting surfaces 176 and three uniformly circumferentially-spaced relief surfaces 177, in this embodiment, the radial centerlines of cutting surfaces 176 are angularly spaced 120° apart about axis 175 and the radial centerlines of relief surfaces 177 are angularly spaced 120° apart about axis 175. In this embodiment, each cutting surface 176 has the same geometry and each relief surface 177 has the same geometry. A linear boundary or edge is provided at the intersection of each circumferentially adjacent surface 176, 177, and a linear boundary or edge is provided at the intersection of central surface 174 and each surface 176, 177. In this embodiment, each surface 174, 176, 177 is a planar surface or facet. More specifically, central surface 174 is a planar facet oriented perpendicular to axis 175, and each surface 176, 177 is a planar facet disposed in a plane oriented at an acute angel relative to central axis 175. Each surface 176, 177 slopes axially toward substrate 190 moving radially outward from central surface 174 to the radially outer periphery of cutting face 171. Examples of cutting face geometries that are similar to cutting face 171 are shown and described in US Patent Application Publication No. 2021/0131190, which is hereby incorporated herein by reference in its entirety. As shown in FIG. 6, Each cutter element 170 is rotationally oriented relative to axis 175 such that one cutting surface 176 extends radially inward along the corresponding non-planar cutting face 171 from the corresponding cutting edge 172 and cutting tip 173 toward central axis 175.

As previously described, in this embodiment, each blade 141, 142 includes a row of cutter elements 160, 170 in which cutter elements 160, 170 are arranged in an alternating fashion moving radially outward along the entire length of the corresponding blade 141, 142. Accordingly, as best shown in FIGS. 4 and 5, cutter elements 160 are provided in the cone region 149*a* of bit 100 (on primary blades 141), in the shoulder region 149*b* of bit 100 (on primary blades 141 and secondary blades 142), and in the gage region 149*c* of bit 100 (on primary blades 141 and secondary blades 142); and similarly, cutter elements 170 are provided in the cone region 149*a* of bit 100 (on primary blades 141), in the shoulder region 149*b* of bit 100 (on primary blades 141 and secondary blades 142), and in the gage region 149*c* of bit 100 (on primary blades 141 and secondary blades 142).

Figure 7:
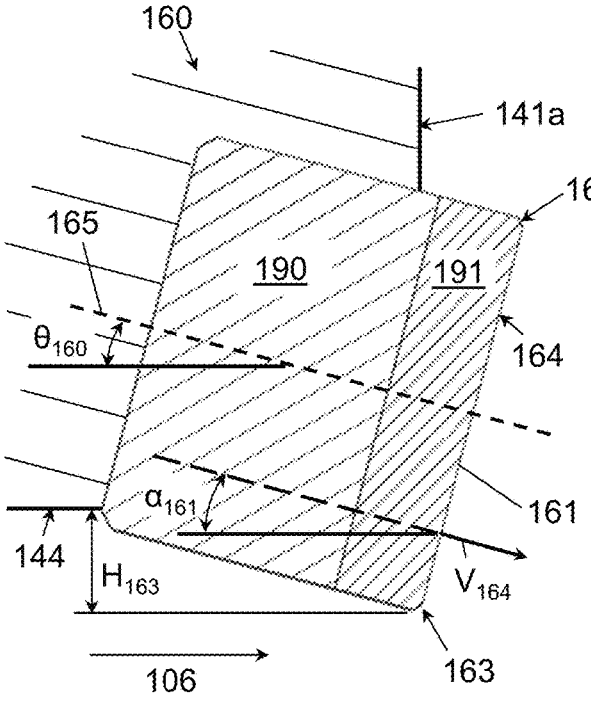
FIG. 7 is a cross-sectional side view of one of the cutter elements of FIG. 6.

Referring now to FIGS. 7 and 8, cross-sectional side views of exemplary cutter elements 160, 170 taken in a plane oriented perpendicular to cutter supporting surface 144 and containing axis 165, 175, respectively, are shown. Although each cutter element 160 is disposed at a different radial position relative to central axis 105 of bit 100, each cutter element 160 is mounted to the corresponding blade 141, 142 in the same orientation relative to the corresponding cutter-supporting surface 144; and although each cutter element 170 is disposed at a different radial position relative to central axis 105 of bit 100, each cutter element 170 is mounted to the corresponding blade 141, 142 in the same orientation relative to the corresponding cutter-supporting surface 144. Accordingly, the mounting orientation of one cutter element 160 is shown in FIG. 7 and will be described below with the understanding that each cutter element 160 is mounted to the corresponding blade 141, 142 in the same manner; and the mounting orientation of one cutter element 170 is shown in FIG. 8 and will be described below with the understanding that each cutter element 170 is mounted to the corresponding blade 141, 142 in the same manner.

Referring first to FIG. 7, cutter element 160 includes substrate 190 fixably seated in a pocket in cutter-supporting surface 144 and hard cutting layer 191 mounted to substrate 190 as previously described. Forward-facing cutting face 161 on the exposed end of cutting layer 191 comprises planar surface 164. Cutting tip 163 defines the extension height $H_{163}$ of cutter element 160 and cutting face 161, which is measured perpendicularly from cutter-supporting surface 144 to cutting tip 163. Cutter element 160 is mounted with central axis 165 oriented at an acute angle $\alpha$160 measured between axis 165 and cutter-supporting surface 144. It should be appreciated that during drilling operations, cutter-supporting surface 144 is parallel to the surface of the formation being cut by cutter element 160, and thus, central axis 165 is also oriented at acute angle $\alpha$160 relative to the surface of the formation being cut by cutter element 160. Angle $\alpha$160 may also be commonly known as a "rake angle," or more specifically, a "backrake angle" as cutter element 160 is tilted backward such that cutting face 161 generally slopes rearwardly relative to the cutting direction 106 moving radially outward along cutting face 161 toward cutting tip 163.

In general, the surface of a cutting face that extends radially from the cutting tip represents the portion of the cutting face that engages and shears the formation. Accordingly, the orientation of that surface can have a significant impact on drilling performance. The orientation of the surface of a cutting face that extends radially from the cutting tip of the cutting face toward the central axis of the cutter element can be quantified by an "effective rake angle" measured between the surface vector of that surface (i.e., a vector oriented perpendicular to the surface) and the corresponding cutter-supporting surface (or the surface of the formation being cut by the cutter element). If the surface of the cutting face that extends radially from the cutting tip slopes rearwardly relative to the cutting direction moving radially outward along the surface to the cutting tip, the "effective rake angle" may also be referred to as an "effective backrake angle."

As shown in FIG. 7 and previously described, the entire cutting face 161 of cutter element 160 is defined by planar surface 164, and thus, the portion of cutting face 161 extending radially from cutting tip 163 toward central axis 165 is planar surface 164. As also previously described, planar surface 164 is oriented perpendicular to axis 165, and thus, is defined by a surface vector $V_{164}$ that is oriented parallel to axis 165. Accordingly, the surface of cutting face 161 extending radially from tip 163 toward central axis 165 (i.e., planar surface 164) is oriented at an effective backrake angle $\alpha_{161}$. Since planar surface 164 extends radially from cutting tip 163 to central axis 165 and surface vector $V_{164}$ is oriented parallel to axis 165, effective backrake angle $\alpha_{161}$ is the same as backrake angle $\theta_{160}$. Backrake angle $\theta_{160}$ and effective backrake angle $\alpha_{161}$ are the same and range from 0° to 45°, alternatively range from 5° to 30°, and alternatively range from 10° to 25°. In this embodiment, Backrake angle $\theta_{160}$ and effective backrake angle $\alpha_{161}$ are 20°.

In the embodiment of cutter element 160 shown in FIG. 7 and described above, effective backrake angle $\alpha_{161}$ is the same as backrake angle $\theta_{160}$. However, embodiments of cutter elements having non-planar cutting faces (e.g., cutter element 170), the effective rake angle (or effective backrake angle) can be different from the rake angle (or backrake angle).

Referring now to FIG. 8, cutter element 170 includes substrate 190 fixably seated in a pocket in cutter-supporting surface 144 and hard cutting layer 191 mounted to substrate 190 as previously described. Forward-facing cutting face 171 on the exposed end of cutting layer 191 comprises planar surfaces 174, 176, 177 as previously described. Cutting tip 173 defines the extension height $H_{173}$ of cutter element 170 and cutting face 171, which is measured perpendicularly from cutter-supporting surface 144 to cutting tip 173. Cutter element 170 is mounted with central axis 175 oriented at an acute angle $\theta$170 measured between axis 175 and cutter-supporting surface 144 (or the formation being cut by cutter element 170). Similar to angle $\theta_{160}$ previously described, angle $\theta$170 may also be commonly known as a "rake angle," or more specifically, a "backrake angle" as cutter element 170 is tilted backward such that cutting face 171 generally slopes rearwardly relative to the cutting direction 106 moving radially outward along cutting face 171 toward cutting tip 173.

As shown in FIG. 8 and previously described, unlike cutting face 161 of cutter element 160, cutting face 171 of cutter element 170 is non-planar (i.e., is not defined by single planar surface 164). Due to the rotational orientation of cutter element 170 about axis 175, one cutting surface 176 extends radially from cutting tip 173 toward central axis 175. In other words, none of the other planar surfaces 174, 177 of cutting face 171 extend radially from cutting tip 173. The planar cutting surface 176 extending radially from cutting tip 173 is defined by a surface vector $V_{176}$, and is oriented at an effective backrake angle $\alpha_{171}$. In this embodiment, surface vector $V_{176}$ is not oriented parallel to axis 175, and thus, effective backrake angle $\alpha_{171}$ is different from backrake angle $\theta_{170}$. In this embodiment, backrake angle $\theta_{170}$ of cutter element 170 is the same as backrake angle $\theta_{160}$ of cutter element 160, and thus, backrake angle $\theta_{170}$ of cutter element 170 ranges from 0° to 45°, alternatively ranges from 5° to 30°, and alternatively ranges from 10° to 25°. Effective backrake angle $\alpha_{171}$ is greater than backrake angle $\theta_{170}$, and in particular, is 0° to 20° greater than backrake angle $\theta_{170}$, and alternatively 5° to 15° greater than backrake angle $\theta_{170}$. As backrake angles $\theta_{160}$, $\theta_{170}$ are the same, and backrake angle $\theta_{160}$ and effective backrake angle $\alpha_{161}$ are the same, effective backrake angle $\alpha_{171}$ is greater than effective backrake angle $\alpha_{161}$, and in particular, is 0° to 20° greater than effective backrake angle $\alpha_{161}$, and alternatively 5° to 15° greater than effective backrake angle $\alpha_{161}$.

Figure 9:
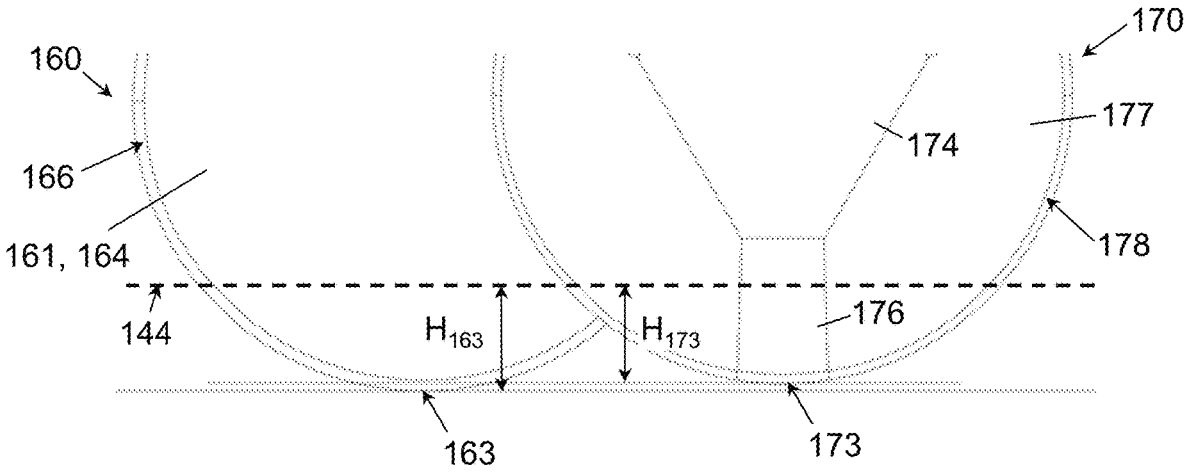
FIG. 9 is an enlarged front, rotated profile view of two cutter elements of the drill bit of FIG. 2.

In this embodiment, backrake angle $\theta_{170}$ of cutter element 170 is the same as backrake angle $\theta_{160}$ of cutter element 160, however, effective backrake angle $\alpha_{171}$ is different from effective backrake angle $\alpha_{161}$. Thus, it should be appreciated that despite backrake angles $\theta_{160}$, $\theta_{170}$ being the same and the diameter of cutter elements 160, 170 being the same, non-planar cutting faces 171 of cutter elements 170 enable cutting faces 171 to have different effective backrake angles $\alpha_{171}$ as compared to effective backrake angles $\alpha_{161}$ of cutting faces 161. Differences in effective backrake angles $\alpha_{161}$, $\alpha_{171}$ can also result in slight differences in extension heights $H_{163}$, $H_{173}$ despite backrake angles $\theta_{160}$, $\theta_{170}$ being the same and the diameter of cutter elements 160, 170 being the same. Referring briefly to FIG. 9, front rotated profile views of two cutter elements 160, 170 having radially adjacent radial positions are shown. As shown in FIG. 9, increased effective backrake angle $\alpha_{171}$ of cutting face 171 results in extension height $H_{173}$ of non-planar cutting face 173 being slightly less than extension height $H_{163}$ of cutting face 163.

In general, the greater the effective backrake angle, the less aggressive the cutter element; and the lower the extension height, the less aggressive the cutter element. Accordingly, cutter elements 170 having non-planar cutting faces 171 are generally less aggressive than cutter elements 160 with planar cutting faces 171. Without being limited by this or any particular theory, alternating the generally less aggressive cutter elements 170 and the more aggressive cutter elements 160 along each blade 141, 142, particularly along cone region 149*a* of drill bit 100, offers the potential to reduce torsional vibrations and oscillations without a significant reduction in the rate of penetration (ROP) of drill bit 100 during drilling operations. It should also be appreciated, that the use of cutter elements 160, 170 having cutting faces 161, 171 with different geometries enables differences in effective backrake angles $\alpha_{161}$, $\alpha_{171}$ of cutting faces 161, 171 and differences in extension heights $H_{163}$, $H_{173}$ of cutter elements 160, 170 despite cutter elements 160, 170 being mounted to cutter-supporting surfaces 144 with the same backrake angles $\theta_{160}$, $\theta_{170}$ and having the same diameters. This may be particularly beneficial when it is desirable to adjust the aggressiveness of select cutter elements when it may be inconvenient or not possible to change the backrake angles (e.g., when retro-fitting or converting an existing bit body with pre-formed pockets on the blades for mounting cutter elements).

In the embodiment of drill bit 100 described above, cutter elements 160, 170 are arranged in an alternating manner along cutter-supporting surface of each blade 141, 142. However, in other embodiments, alternative arrangements of cutter elements having different effective backrake angles due to different cutting face geometries (e.g, cutter elements 160, 170) can be employed. For example, in some embodiments, cutter elements with different cutting face geometries (e.g., planar and non-planar) resulting in different effective backrake angles are arranged in an alternating manner in sequential radial positions (as opposed to alternating on each blade); and in other embodiments, cutter elements with different cutting face geometries (e.g., planar and non-planar) resulting in different effective backrake angles are arranged such that each blade only includes cutter elements having the same cutting face geometry, but different blades include cutter elements having different cutting face geometries.

Figure 10:
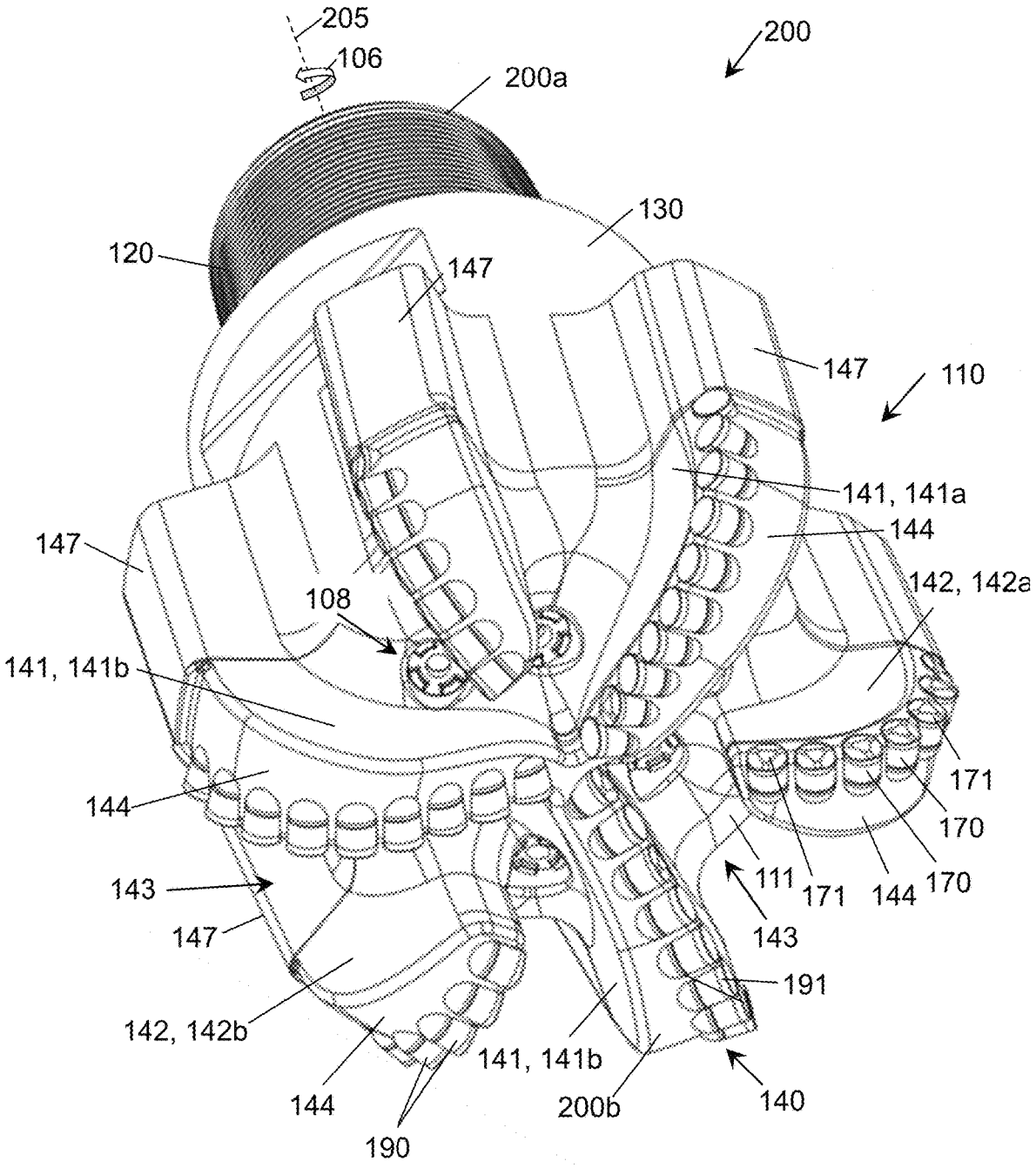
FIG. 10 is a perspective view of an embodiment of a drill bit in accordance with the principles described herein.
Figure 11:
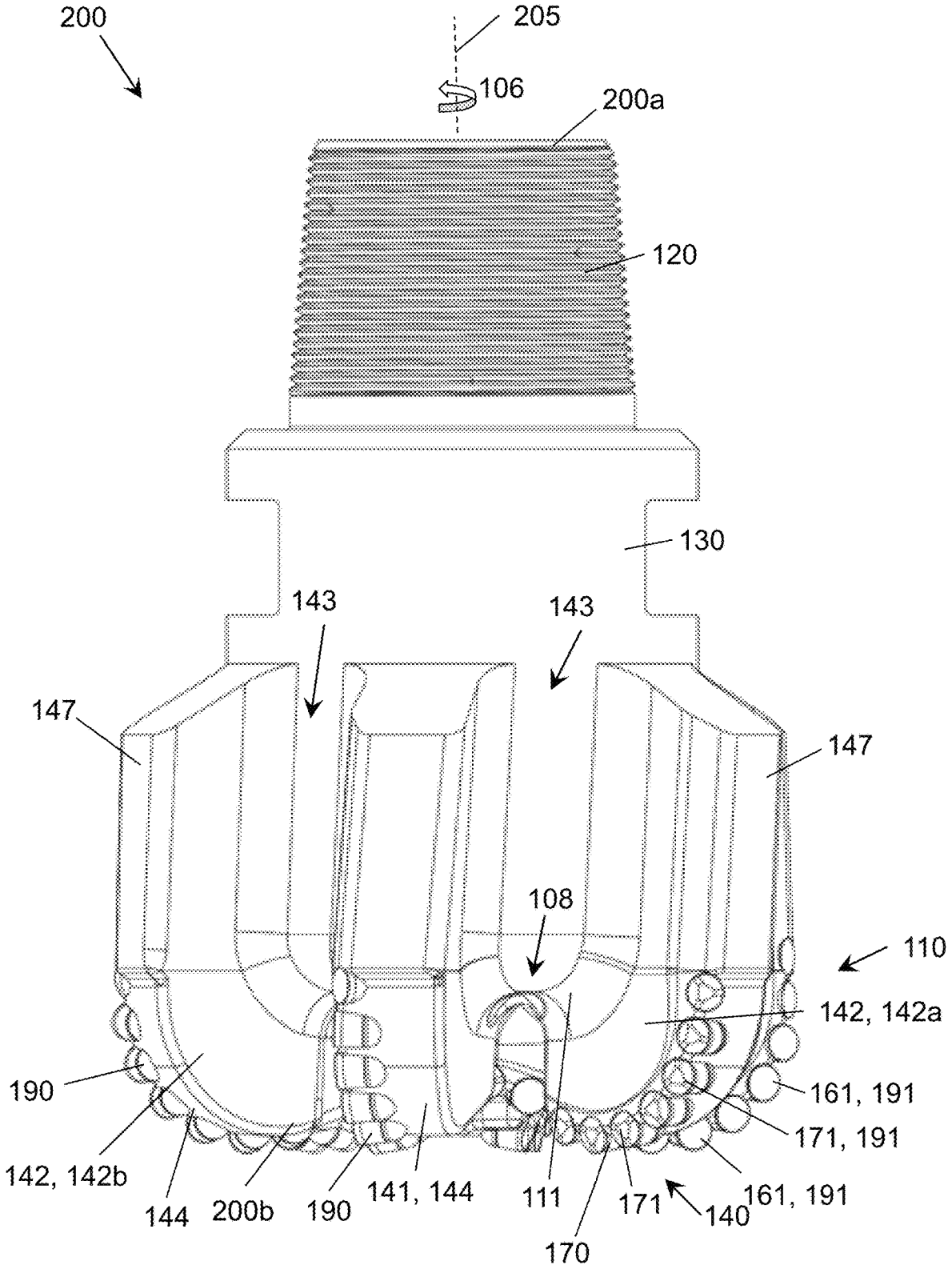
FIG. 11 is a side view of the drill bit of FIG. 10.
Figure 12:
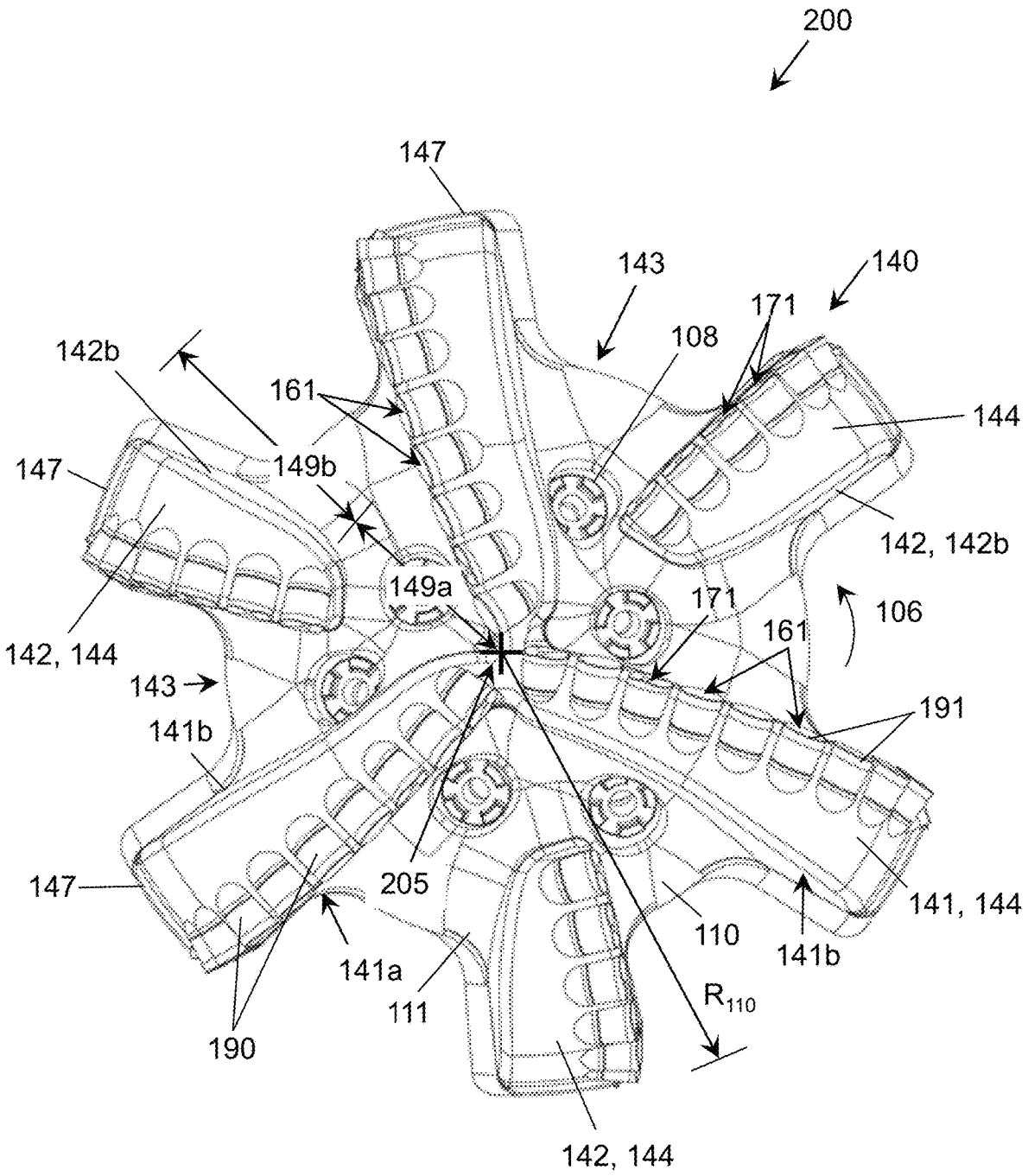
FIG. 12 is an end view of the drill bit of FIG. 10.

Referring now to FIGS. 10-12, an embodiment of a drill bit 200 that can be used in place of drill bit 100 is shown. Drill bit 200 is the same as drill bit 100 previously described with the exception of the arrangement of cutter elements 160, 170. More specifically, drill bit 200 has a central or longitudinal axis 205, a first or uphole end 200*a*, a second or downhole end 200*b*, and rotates about axis 205 in the cutting direction 206. In addition, bit 200 includes a bit body 110 extending axially from downhole end 200*b*, a threaded connection or pin 120 extending axially from uphole end 200*a*, and a shank 130 extending axially between pin 120 and body 110. Bit body 110, pin 120, and shank 130 are each as previously described. For example, the portion of bit body 110 that faces the formation at downhole end 200*b* includes a bit face 111 provided with a cutting structure 140. Cutting structure 140 includes a plurality of primary blades 141 as previously described and a plurality of secondary blades 142 as previously described circumferentially arranged in an alternating fashion. One gage pad 147 intersects and extends from each blade 141, 142. The composite blade profile of bit 200 and bit face 111 include a cone region 149*a*, a shoulder region 149*b*, and a gage region 149*c*, each as previously described.

A plurality of cutter elements 160, 170 as previously described are mounted to cutter-supporting surfaces 144 of blades 141, 142. More specifically, a single row of cutter elements 160, 170 is provided on each blade 141, 142. However, cutter elements 160, 170 are not arranged in an alternating manner along cutter-supporting surface 144 of each blade 141, 142. Rather, in this embodiments, cutter elements 160, 170 are arranged in an alternating manner in sequential radial positions along cutter-supporting surfaces 144 of primary blades 141 within the cone region 149*a*, and in the shoulder region 149*b* and gage region 149*c*, each blade 141, 142 only includes cutter elements 160 or cutter elements 170. More specifically, within cone region 149*a*, cutter elements 160, 170 are arranged such that one cutter element 170 is disposed at the radially innermost position on one primary blade 141, one cutter element 160 is disposed at the next most radially inner position on a different primary blade 141, one cutter element 170 is disposed at yet the next most radially inner position on yet another different primary blade 141, and so on; and within shoulder region 149*b* and gage region 149*c*, cutter elements 160 are arranged in a row along cutter-supporting surface 144 of each primary blade 141 but are not provided on any secondary blades 142, and cutter elements 170 are arranged in a row along cutter-supporting surface 144 of each secondary blade 142 but are not provided on any primary blades 141.

Cutter elements 160, 170 are mounted to cutter-supporting surfaces 144 of the corresponding blades 141, 142 in the same manner as previously described with respect to drill bit 100. Namely, each cutter element 160, 170 is oriented at a backrake angle $\theta_{160}$, $\theta_{170}$ as previously described, and each cutting face 161, 171 has an effective backrake angle $\alpha_{161}$, $\alpha_{171}$, respectively, as previously described. Thus, backrake angle $\theta_{170}$ of each cutter element 170 is the same as backrake angle $\theta_{160}$ of each cutter element 160, however, effective backrake angle $\alpha_{171}$ of each cutting face 171 is different from effective backrake angle $\alpha_{161}$ of each cutting face 161. Differences in effective backrake angles $\alpha_{161}$, $\alpha_{171}$ result in slight differences in extension heights $H_{163}$, $H_{173}$ of cutting faces 161, 171. As with bit 100 previously described, in this embodiment, backrake angle $\theta_{160}$ and effective backrake angle $\alpha_{161}$ are the same and range from 0° to 45°, alternatively range from 5° to 30°, and alternatively range from 10° to 25°. Backrake angle $\theta_{170}$ of cutter element 170 is the same as backrake angle $\theta_{160}$ of cutter element 160, and thus, backrake angle $\theta_{170}$ of cutter element 170 ranges from 0° to 45°, alternatively ranges from 5° to 30°, and alternatively ranges from 10° to 25°. Effective backrake angle $\alpha_{171}$ is greater than backrake angle $\theta_{170}$, and in particular, is 0° to 20° greater than backrake angle $\theta_{170}$, and alternatively 5° to 15° greater than backrake angle $\theta_{170}$. The use of different cutter elements 160, 170 on bit 200 that are oriented in the same manner as bit 100 but arranged differently offer the potential for similar benefits.

In the embodiments of bits 100, 200 previously described, cutter elements 160, 170 are mounted to blades 141, 142 with the same backrake angles $\theta_{160}$, $\theta_{170}$ but exhibit different effective backrake angles $\alpha_{161}$, $\alpha_{171}$ due to differences in the geometries of cutting faces 161, 171—cutting faces 161 are entirely planar whereas cutting faces 171 are non-planar. However, in other embodiments, cutting faces with alternative non-planar cutting faces may be used with planar cutting faces (e.g., cutting faces 161) on the same drill bit, two or more different non-planar cutting faces may be used on the same drill bit, or combinations thereof to achieve similar functionality and benefits as the arrangements of cutter elements 160, 170 described above.

Figure 13:
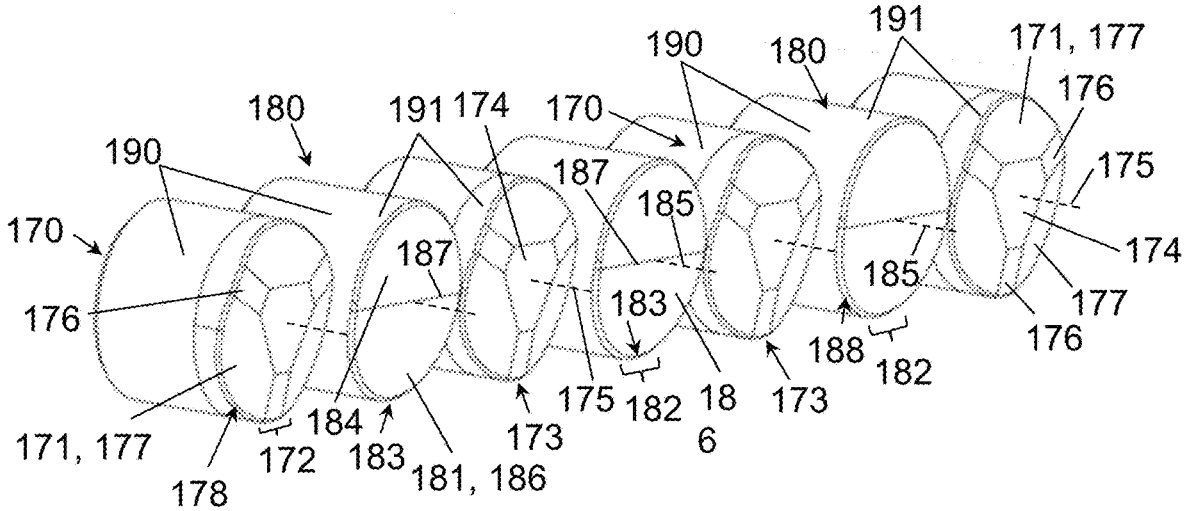
FIG. 13 is a perspective front view of a portion of a row of cutter elements on a blade of a drill bit in accordance with the principles described herein.

Referring now to FIG. 13, a portion of an exemplary row of cutter elements 170, 180 on a blade (e.g., a primary blade 141 or a secondary blade 142) is shown. For purposes of clarity, the corresponding blade is not shown in FIG. 13, however, it is to be understood that cutter elements 170, 180 are shown in FIG. 13 with their lower portions adjacent the formation being drilled and the remainder of the associated drill bit positioned above cutter elements 170, 180. In the embodiment shown in FIG. 13, cutter elements 170, 180 are arranged in a row in an alternating fashion such that two cutter elements 170 are not positioned radially adjacent one another, and two cutter elements 180 are not positioned radially adjacent one another. Stated differently, one cutter element 170 is radially positioned between each pair of radially adjacent cutter elements 180 on the corresponding blade, and one cutter element 180 is radially positioned between each pair of radially adjacent cutter elements 170 on the corresponding blade. Cutter elements 170, 180 may be provided in the cone region of the corresponding bit (e.g., along cone region 149*a*), in the shoulder region of the corresponding bit (e.g., along shoulder region 149*b*), in the gage region of the corresponding bit (e.g., along gage region 149*c*), or combinations thereof. However, as previously described, it may be particularly beneficial to include cutter elements 170, 180 in at least the cone region.

Cutter elements 170 are as previously described. Namely, each cutter element 170 includes substrate 190 and hard cutting layer 191 mounted to substrate 190. Cutting layers 191 includes non-planar cutting face 171, which has a cutting edge 172 configured to positively engage, penetrate, and remove formation material via a shearing action. In addition, cutting face 171 includes cutting tip 173 disposed along the cutting edge 172 and defining extension height $H_{173}$ (FIG. 8) and radial position of the corresponding cutter element 170. Still further, non-planar cutting face 171 includes planar central surface 174, planar cutting surfaces 176 extending radially from central region 174 to the radially outer periphery of cutting face 171, and planar relief surfaces 177 extending from central region 174 and cutting surfaces 176 to the radially outer periphery of cutting face 171. As shown in FIG. 13, each cutter element 170 is rotationally oriented relative to axis 175 such that one cutting surface 176 extends radially inward along the corresponding non-planar cutting face 171 from the corresponding cutting edge 172 and cutting tip 173 toward central axis 175.

Figure 14:
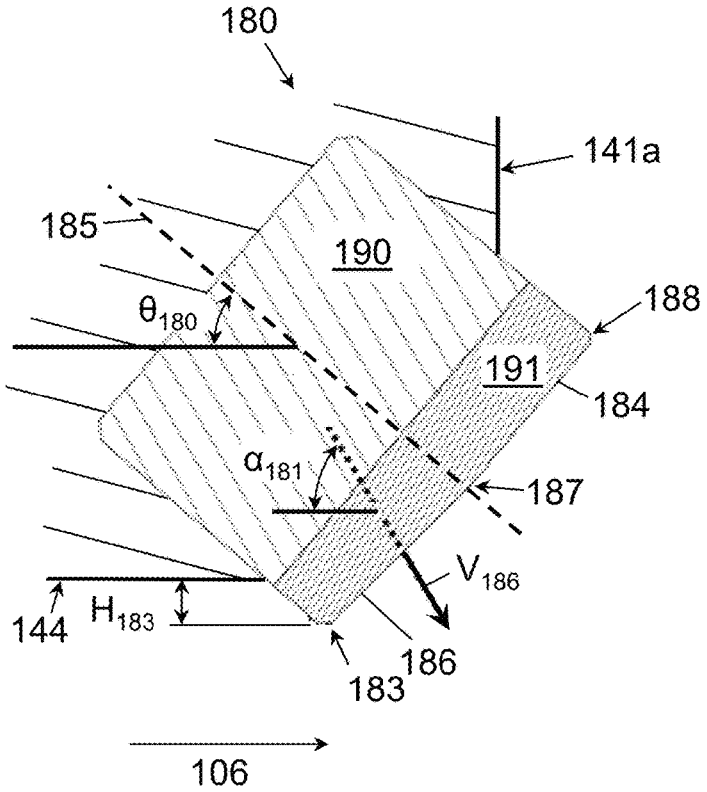
FIG. 14 is a cross-sectional side view of one of the cutter elements of FIG. 13.

Referring now to FIGS. 13 and 14, each cutter element 180 is the same, and thus, one cutter element 180 will be described with the understanding the other cutter elements 180 are identical. In this embodiment, cutter element 180 includes a substrate 190 and a hard-cutting layer 191 mounted to substrate 190. Cutter element 180 has a central or longitudinal axis 185, which is generally defined by the coaxially aligned central axes of substrate 190 and cutting layer 191 of cutter element 180. In FIG. 14, a cross-sectional side view of one cutter element 180 mounted to a cutter-supporting surface 144 and taken in a plane oriented perpendicular to cutter supporting surface 144 to which it is mounted and containing axis 185 is shown. The cylindrical disc, hard cutting layer 191 defines a forward-facing cutting face 181 of cutter element 180. Each cutting face 181 includes a cutting edge 182 distal the corresponding cutter supporting surface. Cutting edge 182 is configured to positively engage, penetrate, and remove formation material via a shearing action. In this embodiment, each cutting edge 182 is chamfered or beveled. Each cutting face 181 also includes a cutting tip 183 that is disposed along the cutting edge 182 and defines an extension height $H_{183}$ of the corresponding cutter element 180.

In this embodiment, cutting face 181 is not completely planar, but rather, includes a plurality of planar surfaces or facets that intersect at distinct edges along the cutting face 181. Accordingly, cutting face 181 may also be described as "non-planar." Non-planar cutting face 181 is generally convex or bowed outward. In particular, non-planar cutting face 181 is defined by a plurality of discrete regions or surfaces that intersect at linear boundaries or edges. More specifically, non-planar cutting face 181 includes a first or upper planar surface 184 and a second or lower planar surface 186. Surfaces 184, 186 intersect at a linear edge 187 that extends diametrically across cutting face 181, bisects cutting face 181, and intersects axis 185. Surfaces 184, 186 extend in opposite directions from edge 187 to the radially outer periphery of cutting face 181. Thus, each surface 184, 186 extends angularly 180° about central axis 185 and has a generally semi-cylindrical profile in front view (as viewed parallel to axis 185). A chamfer 188 extends circumferentially about cutting face 181 and layer 191, and extends axially from cutting face 181. In other words, chamfer 188 intersects surfaces 184, 186 along the radially outer edge of cutting face 181.

Each cutter element 170 is mounted to the corresponding blade in the same orientation relative to the corresponding cutter-supporting surface (e.g., cutter-supporting surface 144). In addition, each cutter element 180 is mounted to the corresponding blade in the same orientation relative to the corresponding cutter-supporting surface. The mounting orientation of each cutter element 170 is the same as previously described and shown in FIG. 8. The mounting orientation of one cutter element 180 is shown in FIG. 14 and will now be described below with the understanding that each cutter element 180 is mounted to the corresponding blade in the same manner.

Referring now to FIG. 14, cutter element 180 is mounted with central axis 185 oriented at an acute angle $\theta_{180}$ measured between axis 185 and cutter-supporting surface 144 (or the formation being cut by cutter element 180). Similar to angle $\theta_{170}$ previously described, angle $\theta_{180}$ may also be commonly known as a "rake angle," or more specifically, a "backrake angle" as cutter element 180 is tilted backward such that cutting face 181 generally slopes rearwardly relative to the cutting direction 106 moving radially outward along cutting face 181 toward cutting tip 183.

As shown in FIG. 14 and previously described, cutting face 181 of cutter element 180 is non-planar (i.e., is not defined by single planar surface). Due to the rotational orientation of cutter element 180 about axis 185, second planar surface 186 extends radially from cutting tip 183 toward central axis 185. The planar cutting surface 186 extending radially from cutting tip 183 is defined by a surface vector $V_{186}$, and is oriented at an effective backrake angle $\alpha_{181}$. In this embodiment, surface vector $V_{176}$ is not oriented parallel to axis 185, and thus, effective backrake angle $\alpha_{181}$ is different from backrake angle $\theta_{180}$. In this embodiment, backrake angle $\theta_{180}$ of cutter element 180 is the same as backrake angle $\theta_{170}$ of cutter element 170, and thus, backrake angle $\theta_{170}$ of cutter element 170 ranges from 0° to 45°, alternatively ranges from 5° to 30°, and alternatively ranges from 10° to 25°. Effective backrake angle $\alpha_{181}$ is greater than effective backrake angle $\alpha_{171}$, and in particular, is 0° to 20° greater than effective backrake angle $\alpha_{171}$, and alternatively 5° to 15° greater than effective backrake angle $\alpha_{171}$.

In this embodiment, backrake angle $\theta_{180}$ of cutter element 180 is the same as backrake angle $\theta_{170}$ of cutter element 170, however, effective backrake angle $\alpha_{181}$ is different from effective backrake angle $\alpha_{171}$. Thus, it should be appreciated that despite backrake angles $\theta_{170}$, $\theta_{180}$ being the same and the diameter of cutter elements 170, 180 being the same, non-planar cutting faces 181 of cutter elements 180 enable cutting faces 181 to have different effective backrake angles $\alpha_{181}$ as compared to effective backrake angles $\alpha_{171}$ of cutting faces 171. Differences in effective backrake angles $\alpha_{171}$, $\alpha_{181}$ can also result in slight differences in extension heights $H_{173}$, $H_{183}$ despite backrake angles $\theta_{170}$, $\theta_{180}$ being the same and the diameter of cutter elements 170, 180 being the same.

In general, the greater the effective backrake angle, the less aggressive the cutter element; and the lower the extension height, the less aggressive the cutter element. Accordingly, cutter elements 180 having non-planar cutting faces 181 are generally less aggressive than cutter elements 170 with non-planar cutting faces 171. Without being limited by this or any particular theory, including the generally less aggressive cutter elements 180 and the more aggressive cutter elements 170 along one or more blades (e.g., blades 141, 142), particularly along the cone region (e.g., cone region 149*a*) of the drill bit, offers the potential to reduce torsional vibrations and oscillations without a significant reduction in the rate of penetration (ROP) of the drill bit during drilling operations. It should also be appreciated, that the use of cutter elements 170, 180 having cutting faces 171, 181 with different geometries enables differences in effective backrake angles $\alpha_{171}$, $\alpha_{181}$ of cutting faces 171, 181 and differences in extension heights $H_{173}$, $H_{183}$ of cutter elements 170, 180 despite cutter elements 170, 180 being mounted to cutter-supporting surfaces 144 with the same backrake angles $\theta_{170}$, $\theta_{180}$ and having the same diameters. This may be particularly beneficial when it is desirable to adjust the aggressiveness of select cutter elements when it may be inconvenient or not possible to change the backrake angles (e.g., when retro-fitting or converting an existing bit body with pre-formed pockets on the blades for mounting cutter elements).

Figure 15:
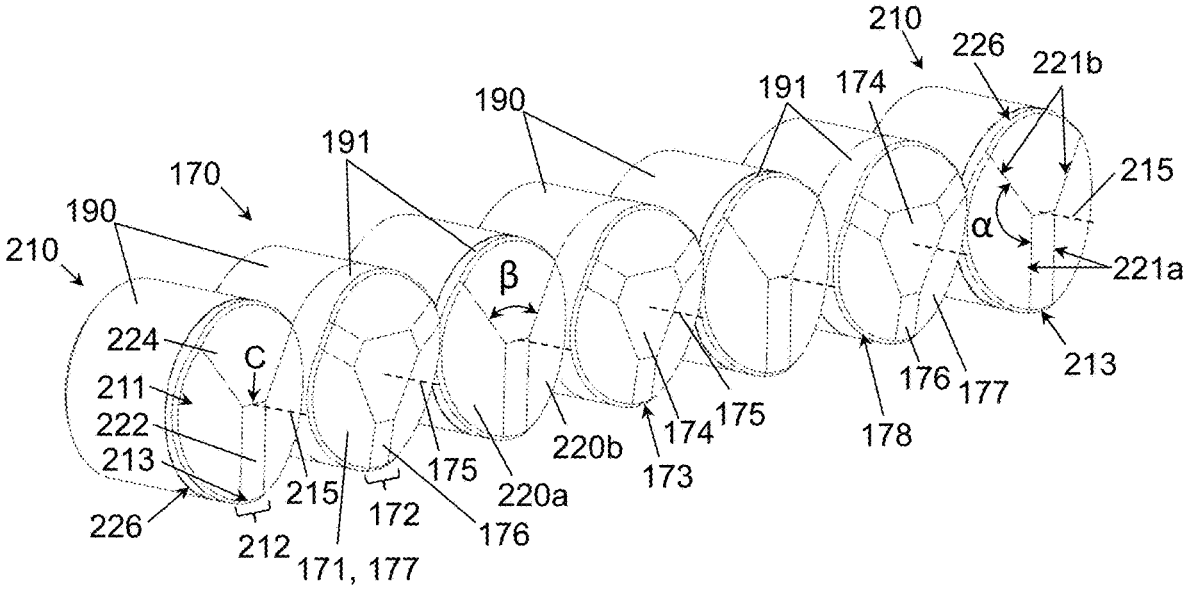
FIG. 15 is a perspective front view of a portion of a row of cutter elements on a blade of a drill bit in accordance with principles described herein.

Referring now to FIG. 15, a portion of an exemplary row of cutter elements 170, 210 on a blade (e.g., a primary blade 141 or a secondary blade 142) is shown. For purposes of clarity, the corresponding blade is not shown in FIG. 15, however, it is to be understood that cutter elements 170, 210 are shown in FIG. 15 with their lower portions adjacent the formation being drilled and the remainder of the associated drill bit positioned above cutter elements 170, 210. In the embodiment shown in FIG. 15, cutter elements 170, 210 are arranged in a row in an alternating fashion such that two cutter elements 170 are not positioned radially adjacent one another, and two cutter elements 210 are not positioned radially adjacent one another. Stated differently, one cutter element 170 is radially positioned between each pair of radially adjacent cutter elements 210 on the corresponding blade, and one cutter element 210 is radially positioned between each pair of radially adjacent cutter elements 170 on the corresponding blade. Cutter elements 170, 210 may be provided in the cone region of the corresponding bit (e.g., along cone region 149*a*), in the shoulder region of the corresponding bit (e.g., along shoulder region 149*b*), in the gage region of the corresponding bit (e.g., along gage region 149*c*), or combinations thereof. However, as previously described, it may be particularly beneficial to include cutter elements 170, 210 in at least the cone region.

Cutter elements 170 are as previously described. Namely, each cutter element 170 includes substrate 190 and hard cutting layer 191 mounted to substrate 190. Cutting layers 191 includes non-planar cutting face 171, which has a cutting edge 172 configured to positively engage, penetrate, and remove formation material via a shearing action. In addition, cutting face 171 includes cutting tip 173 disposed along the cutting edge 172 and defining extension height $H_{173}$ (FIG. 8) and radial position of the corresponding cutter element 170. Still further, non-planar cutting face 171 includes planar central surface 174, planar cutting surfaces 176 extending radially from central region 174 to the radially outer periphery of cutting face 171, and planar relief surfaces 177 extending from central region 174 and cutting surfaces 176 to the radially outer periphery of cutting face 171. As shown in FIG. 15, each cutter element 170 is rotationally oriented relative to axis 175 such that one cutting surface 176 extends radially inward along the corresponding non-planar cutting face 171 from the corresponding cutting edge 172 and cutting tip 173 toward central axis 175.

Figure 16:
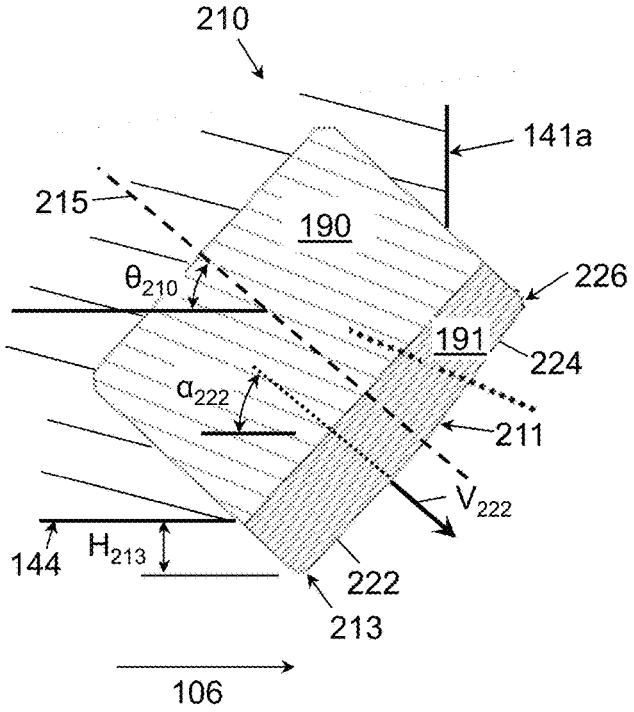
FIG. 16 is a cross-sectional side view of one of the cutter elements of FIG. 15.

Referring now to FIGS. 15 and 16, each cutter element 210 is the same, and thus, one cutter element 210 will be described with the understanding the other cutter elements 210 are identical. In this embodiment, cutter element 210 includes a substrate 190 and a hard-cutting layer 191 mounted to substrate 190. Cutter element 210 has a central or longitudinal axis 215, which is generally defined by the coaxially aligned central axes of substrate 190 and cutting layer 191 of cutter element 210. In FIG. 16, a cross-sectional side view of one cutter element 210 mounted to a cutter-supporting surface 144 and taken in a plane oriented perpendicular to cutter supporting surface 144 to which it is mounted and containing axis 215 is shown. The cylindrical disc, hard cutting layer 191 defines a forward-facing cutting face 211 of cutter element 210. Each cutting face 211 includes a cutting edge 212 distal the corresponding cutter supporting surface 144. Cutting edge 212 is configured to positively engage, penetrate, and remove formation material via a shearing action. In this embodiment, each cutting edge 212 is chamfered or beveled. Each cutting face 211 also includes a cutting tip 213 that is disposed along the cutting edge 212 and defines an extension height $H_{213}$ of the corresponding cutter element 210.

In this embodiment, cutting face 211 is not completely planar, but rather, includes a plurality of planar surfaces or facets that intersect at distinct edges along the cutting face 211. Accordingly, cutting face 211 may also be described as "non-planar." Non-planar cutting face 211 is generally convex or bowed outward. In particular, non-planar cutting face 211 is defined by a plurality of discrete regions or surfaces that intersect at linear boundaries or edges. More specifically, non-planar cutting face 211 includes a pair of side regions 220*a*, 220*b*, an elongated ridge 222, a ramp 224, and a chamfer 226 about the outer periphery of cutting face 211. Chamfer 226 defines cutting edge 212. Side regions 220*a*, 220*b* extend radially inward from the outer periphery of cutting face 211 and chamfer 226 of cutter element 210. Each side region 220*a*, 220*b* is a generally pie shaped region defined by linear edges 221*a*, 221*b* that intersect proximal a geometric center C of the cutting face 211 coincident with axis 215 and extend radially therefrom to the outer periphery of cutting face 211 and chamfer 226. Linear edges 221*a*, 221*b* of each side region 220*a*, 220*b* are angularly spaced apart by an angle $\alpha$ measured about axis 215. In this embodiment, each angle $\alpha$ is an obtuse angle and each angle $\alpha$ is the same. More specifically, in this embodiment, each angle $\alpha$ is 135°.

Each side region 220*a*, 220*b* is a planar surface that slopes axially toward substrate 190 moving radially outward from the intersection of edges 221*a*, 221*b* to the outer periphery of cutting face 211 and chamfer 226. More specifically, each side region 220*a*, 220*b* is disposed at a slant angle relative to a plane oriented perpendicular to central axis 215. The slant angle of each side region 220*a*, 220*b* ranges from 0° to 20°. In this embodiment, the slant angle of each side region 220*a*, 220*b* is the same, and in particular, the slant angle of each side region 220*a*, 220*b* is 10°. Side regions 220*a*, 220*b* may be symmetrical relative to each other on either side of ridge 222.

Referring still to FIGS. 15 and 16, ridge 222 is positioned between linear edges 221*a* of side regions 220*a*, 220*b*, thereby separating side regions 220*a*, 220*b*. Ridge 222 is generally perpendicular to and extends radially from cutting tip 212 at the outer periphery of cutting face 211 to ramp 224 and the center C. Thus, in this embodiment, ridge 222 has a length equal to the radius of cutting face 211. However, in general, ridge 222 can have a length ranging from ⅓ to ⅔ of the diameters of cutting face 211. Ridge 222 may have a length selected for bisecting and physically splitting apart extruding rock particle conglomerates or extrudates and directing the smaller, split extrudate portions into the regions 220*a*, 220*b*. Ridge 222 has a width measured between linear edges 221*a*, 221*b*. The width of ridge 222 may be constant and uniform along the entire length thereof.

Ramp 224 defines a third pie shaped region extending radially outward from the center C and the radially inward end of ridge 222 to chamfer 226 and the outer periphery of cutting face 211. Ramp 224 has a curved edge along the outer periphery of cutting face 211 and chamfer 226, and a pair of sides defined by linear edges 221*b* of side regions 220*a*, 220*b*. Thus, ramp 224 is positioned between side regions 220*a*, 220*b*, and in particular, between linear edges 221*b* of side regions 220*a*, 220*b*. Thus, ramp 224 extends angularly between linear edges 221*b* and side regions 220*a*, 220*b*. In particular, linear edges 221*b* of side regions 220*a*, 220*b* are angularly spaced by an angle $\beta$ measured about axis 215 between linear edges 221*b*. In this embodiment, angle $\beta$ is 90°. However, in general, angle $\beta$ can range from 60° degrees to 120°.

Ramp 224 is a planar surface that slopes axially toward substrate 190 moving radially outward from the center C and ridge 222 to the outer periphery of cutting face 211 and chamfer 226. More specifically, ramp 224 is disposed at a slant angle relative to a plane oriented perpendicular to central axis 215. The slant angle of ramp 224 ranges from 0° to 20°. In this embodiment, the slant angle of ramp 224 is 10°.

Referring again to FIG. 15, each cutter element 170 is mounted to the corresponding blade in the same orientation relative to the corresponding cutter-supporting surface (e.g., cutter-supporting surface 144). In addition, each cutter element 210 is mounted to the corresponding blade in the same orientation relative to the corresponding cutter-supporting surface. The mounting orientation of each cutter element 170 is the same as previously described and shown in FIG. 8. The mounting orientation of one cutter element 210 is shown in FIG. 16 and will now be described below with the understanding that each cutter element 210 is mounted to the corresponding blade in the same manner.

Referring now to FIG. 16, cutter element 210 is mounted with central axis 215 oriented at an acute angle $\theta_{210}$ measured between axis 215 and cutter-supporting surface 144 (or the formation being cut by cutter element 210). Similar to angle $\theta_{170}$ previously described, angle $\theta_{210}$ may also be commonly known as a "rake angle," or more specifically, a "backrake angle" as cutter element 210 is tilted backward such that cutting face 211 generally slopes rearwardly relative to the cutting direction 106 moving radially outward along cutting face 211 toward cutting tip 213.

As shown in FIG. 16 and previously described, cutting face 211 of cutter element 210 is non-planar (i.e., is not defined by single planar surface). Due to the rotational orientation of cutter element 210 about axis 215, ridge 222 extends radially from cutting tip 213 toward central axis 215. The planar ridge 222 extending radially from cutting tip 213 is defined by a surface vector $V_{222}$, and is oriented at an effective backrake angle $\alpha_{222}$. In this embodiment, surface vector $V_{222}$ is oriented parallel to axis 215, and thus, effective backrake angle $\alpha_{222}$ is the same as backrake angle $\theta_{210}$. In this embodiment, backrake angle $\theta_{210}$ of cutter element 210 is the same as backrake angle $\theta_{170}$ of cutter element 170, and thus, backrake angle $\theta_{210}$ of cutter element 210 ranges from 0° to 45°, alternatively ranges from 5° to 30°, and alternatively ranges from 10° to 25°. Effective backrake angle $\alpha_{171}$ is greater than effective backrake angle $\alpha_{222}$, and in particular, is 0° to 20° greater than effective backrake angle $\alpha_{222}$, and alternatively 5° to 15° greater than effective backrake angle $\alpha_{222}$.

In this embodiment, backrake angle $\theta_{210}$ of cutter element 210 is the same as backrake angle $\theta_{170}$ of cutter element 170, however, effective backrake angle $\alpha_{222}$ is different from effective backrake angle $\alpha_{171}$. Thus, it should be appreciated that despite backrake angles $\theta_{170}$, $\theta_{210}$ being the same and the diameter of cutter elements 170, 210 being the same, non-planar cutting faces 211 of cutter elements 210 enable cutting faces 211 to have different effective backrake angles $\alpha_{222}$ as compared to effective backrake angles $\alpha_{171}$ of cutting faces 171. Differences in effective backrake angles $\alpha_{171}$, $\alpha_{222}$ can also result in slight differences in extension heights $H_{173}$, $H_{213}$ despite backrake angles $\theta_{170}$, $\theta_{210}$ being the same and the diameter of cutter elements 170, 210 being the same.

In general, the greater the effective backrake angle, the less aggressive the cutter element; and the lower the extension height, the less aggressive the cutter element. Accordingly, cutter elements 170 having non-planar cutting faces 171 are generally less aggressive than cutter elements 210 with non-planar cutting faces 211. Without being limited by this or any particular theory, including the generally less aggressive cutter elements 170 and the more aggressive cutter elements 210 along one or more blades (e.g., blades 141, 142), particularly along the cone region (e.g., cone region 149*a*) of the drill bit, offers the potential to reduce torsional vibrations and oscillations without a significant reduction in the rate of penetration (ROP) of the drill bit during drilling operations. It should also be appreciated, that the use of cutter elements 170, 210 having cutting faces 171, 211 with different geometries enables differences in effective backrake angles $\alpha_{171}$, $\alpha_{222}$ of cutting faces 171, 211 and differences in extension heights $H_{173}$, $H_{213}$ of cutter elements 170, 210 despite cutter elements 170, 210 being mounted to cutter-supporting surfaces 144 with the same backrake angles $\theta_{170}$, $\theta_{210}$ and having the same diameters. This may be particularly beneficial when it is desirable to adjust the aggressiveness of select cutter elements when it may be inconvenient or not possible to change the backrake angles (e.g., when retro-fitting or converting an existing bit body with pre-formed pockets on the blades for mounting cutter elements).

Figure 17:
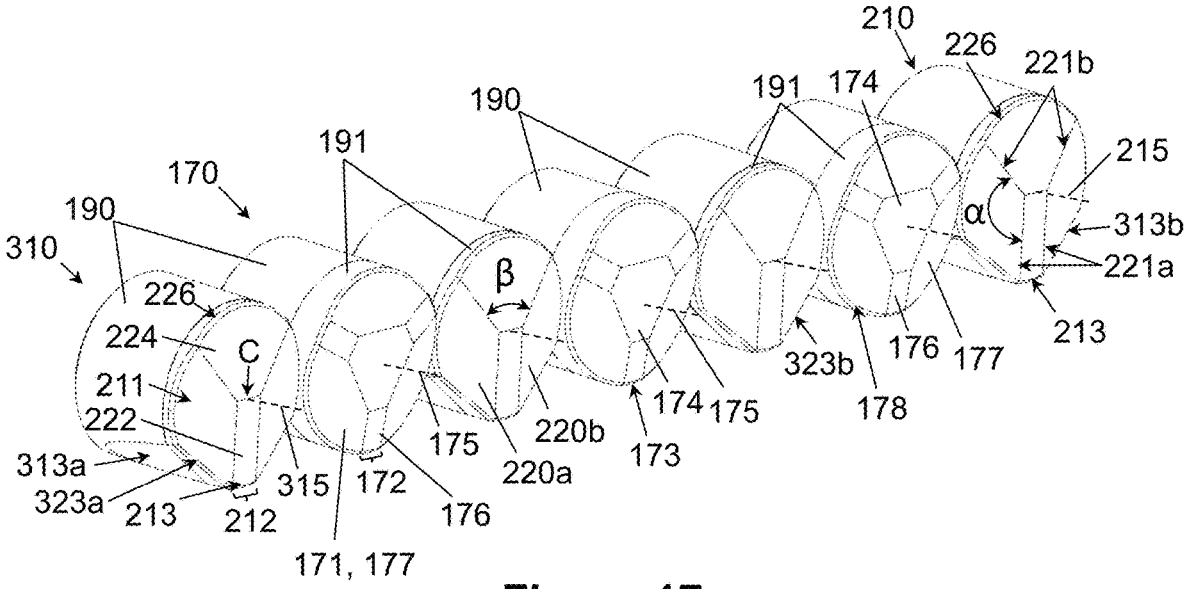
FIG. 17 is a perspective front view of a portion of a row of cutter elements on a blade of a drill bit in accordance with principles described herein.

Referring now to FIG. 17, a portion of an exemplary row of cutter elements 170, 310 on a blade (e.g., a primary blade 141 or a secondary blade 142) is shown. For purposes of clarity, the corresponding blade is not shown in FIG. 17, however, it is to be understood that cutter elements 170, 310 are shown in FIG. 17 with their lower portions adjacent the formation being drilled and the remainder of the associated drill bit positioned above cutter elements 170, 310. In the embodiment shown in FIG. 17, cutter elements 170, 310 are arranged in a row in an alternating fashion such that two cutter elements 170 are not positioned radially adjacent one another, and two cutter elements 310 are not positioned radially adjacent one another. Stated differently, one cutter element 170 is radially positioned between each pair of radially adjacent cutter elements 310 on the corresponding blade, and one cutter element 310 is radially positioned between each pair of radially adjacent cutter elements 170 on the corresponding blade. Cutter elements 170, 310 may be provided in the cone region of the corresponding bit (e.g., along cone region 149*a*), in the shoulder region of the corresponding bit (e.g., along shoulder region 149*b*), in the gage region of the corresponding bit (e.g., along gage region 149*c*), or combinations thereof. However, as previously described, it may be particularly beneficial to include cutter elements 170, 310 in at least the cone region.

Cutter elements 170 are as previously described. Namely, each cutter element 170 includes substrate 190 and hard cutting layer 191 mounted to substrate 190. Cutting layers 191 includes non-planar cutting face 171, which has a cutting edge 172 configured to positively engage, penetrate, and remove formation material via a shearing action. In addition, cutting face 171 includes cutting tip 173 disposed along the cutting edge 172 and defining extension height $H_{173}$ (FIG. 8) and radial position of the corresponding cutter element 170. Still further, non-planar cutting face 171 includes planar central surface 174, planar cutting surfaces 176 extending radially from central region 174 to the radially outer periphery of cutting face 171, and planar relief surfaces 177 extending from central region 174 and cutting surfaces 176 to the radially outer periphery of cutting face 171. As shown in FIG. 17, each cutter element 170 is rotationally oriented relative to axis 175 such that one cutting surface 176 extends radially inward along the corresponding non-planar cutting face 171 from the corresponding cutting edge 172 and cutting tip 173 toward central axis 175.

Referring still to FIG. 17, each cutter element 310 is the same, and thus, one cutter element 310 will be described with the understanding the other cutter elements 310 are identical. Each cutter element 310 is substantially the same as cutter element 210 previously described with the exception that cutter element 310 includes a pair of planar surfaces or flats 313*a*, 313*b*. In particular, cutter element 310 includes a substrate 190 and a hard-cutting layer 191 mounted to substrate 190. In addition, cutter element 310 has a central or longitudinal axis 315, which is generally defined by the coaxially aligned central axes of substrate 190 and cutting layer 191 of cutter element 310. The cylindrical disc, hard cutting layer 191 defines a forward-facing cutting face 211 of cutter element 310. Cutting face 211 is as previously described. Thus, each cutting face 211 includes a cutting edge 212 distal the corresponding cutter supporting surface 144 that is configured to positively engage, penetrate, and remove formation material via a shearing action. Each cutting face 211 also includes a cutting tip 213 that is disposed along the cutting edge 212 and defines an extension height of the corresponding cutter element 310. In addition, non-planar cutting face 211 includes a pair of side regions 220*a*, 220*b*, an elongated ridge 222, a ramp 224, and a chamfer 226 about the outer periphery of cutting face 211, each as previously described.

Unlike cutter element 210 previously described, in this embodiment, cutter element 310 includes the pair of planar surfaces or flats 313*a*, 313*b*, which extend across the radially outer cylindrical surfaces of substrate 190 and cutting layer 191. Each flat 313*a*, 313*b* extends axially from a corresponding chamfer 323*a*, 323*b* at the intersection of flat 313*a*, 313*b* and a corresponding side region 220*a*, 220*b*, respectively, along the radially outer cylindrical surfaces of cutting layer 191 and substrate 190. However, in this embodiment, flats 313*a*, 313*b* do not extend to the opposite end of substrate 190. Each flat 313*a*, 313*b* is contiguous and smooth as it extends across the radially outer cylindrical surfaces of substrate 190 and cutting layer 191. Flats 313*a*, 313*b* are circumferentially spaced and positioned on opposite circumferential sides of ridge 222 and are symmetric relative to plane containing axis 315 and bisecting ridge 222.

Referring still to FIG. 17, each cutter element 170 is mounted to the corresponding blade in the same orientation relative to the corresponding cutter-supporting surface (e.g., cutter-supporting surface 144). In addition, each cutter element 310 is mounted to the corresponding blade in the same orientation relative to the corresponding cutter-supporting surface. The mounting orientation of each cutter element 170 is the same as previously described and shown in FIG. 8, and the mounting orientation of each cutter element 310 is the same as cutter elements 210 previously described and shown in FIGS. 15 and 16.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a blade extending radially along the bit face;

a first cutter element mounted to a cutter-supporting surface of the blade and a second cutter element mounted to the cutter-supporting surface of the blade;

wherein the first cutter element has a central axis and comprises:

a first forward-facing cutting face including a first cutting tip distal the cutter supporting surface and a first planar surface extending radially from the first cutting tip toward the central axis of the first cutter element;

wherein the first planar surface is oriented at a first effective backrake angle measured between the cutter supporting surface and a surface vector of the first planar surface;

wherein the second cutter element has a central axis and comprises:

a second forward-facing cutting face including a second cutting tip distal the cutter supporting surface and a second planar surface extending radially from the second cutting tip toward the central axis of the second cutter element;

wherein the second planar surface is oriented at a second effective backrake angle measured between the cutter supporting surface and a surface vector of the second planar surface;

wherein the second effective backrake angle is greater than the first effective backrake angle;

wherein the first cutting face is completely planar and defined by the first planar surface, and wherein the first cutter element is oriented at a first backrake angle measured between the central axis of the first cutter element and the cutter-supporting surface, and wherein the first effective backrake angle is the same as the first backrake angle;

wherein the second cutting face is non-planar and comprises a plurality of planar surfaces that intersect at distinct edges, wherein the plurality of planar surfaces include the second planar surface.

2. The drill bit of claim 1, wherein the second effective backrake angle is up to 20° greater than the first effective backrake angle.

3. The drill bit of claim 2, wherein the second effective backrake angle is 5° to 15° greater than the first effective backrake angle.

4. The drill bit of claim 1, wherein the first cutter element is radially adjacent the second cutter element on the blade.

5. The drill bit of claim 1, wherein the bit body includes a cone region, a shoulder region, and a gage region, wherein the second cutter element is positioned in the cone region.

6. The drill bit of claim 1, wherein the blade is a primary blade that extends radially outward from proximal the central axis of the drill bit.

7. The drill bit of claim 1, wherein each backrake angle ranges from 10° to 25°.

8. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a blade extending radially along the bit face;

a first cutter element mounted to a cutter-supporting surface of the blade and a second cutter element mounted to the cutter-supporting surface of the blade;

wherein the first cutter element has a central axis and comprises:

a first forward-facing cutting face including a first cutting tip distal the cutter supporting surface and a first planar surface extending radially from the first cutting tip toward the central axis of the first cutter element;

wherein the first planar surface is oriented at a first effective backrake angle measured between the cutter supporting surface and a surface vector of the first planar surface;

wherein the second cutter element has a central axis and comprises:

a second forward-facing cutting face including a second cutting tip distal the cutter supporting surface and a second planar surface extending radially from the second cutting tip toward the central axis of the second cutter element;

wherein the second planar surface is oriented at a second effective backrake angle measured between the cutter supporting surface and a surface vector of the second planar surface;

wherein the second effective backrake angle is greater than the first effective backrake angle;

wherein the first cutter element is oriented at a first backrake angle measured between the central axis of the first cutter element and the cutter-supporting surface, wherein the second cutter element is oriented at a second backrake angle measured between the central axis of the second cutter element and the cutter-supporting surface, wherein the first backrake angle is the same as the second backrake angle.

9. The drill bit of claim 8, wherein the first cutting face is completely planar and defined by the first planar surface, and wherein the first cutter element is oriented at a first backrake angle measured between the central axis of the first cutter element and the cutter-supporting surface, and wherein the first effective backrake angle is the same as the first backrake angle.

10. The drill bit of claim 8, wherein each backrake angle ranges from 10° to 25°.

11. The drill bit of claim 8, wherein the second effective backrake angle is up to 20° greater than the first effective backrake angle.

12. The drill bit of claim 11, wherein the second effective backrake angle is 5° to 15° greater than the first effective backrake angle.

13. The drill bit of claim 8 wherein the first cutter element is radially adjacent the second cutter element on the blade.

14. The drill bit of claim 8, wherein the bit body includes a cone region, a shoulder region, and a gage region, wherein the second cutter element is positioned in the cone region.

15. The drill bit of claim 8, wherein the blade is a primary blade that extends radially outward from proximal the central axis of the drill bit.

16. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a blade extending radially along the bit face;

a first cutter element mounted to a cutter-supporting surface of the blade and a second cutter element mounted to the cutter-supporting surface of the blade;

wherein the first cutter element has a central axis and comprises:

a first forward-facing cutting face including a first cutting tip distal the cutter supporting surface and a first planar surface extending radially from the first cutting tip toward the central axis of the first cutter element;

wherein the first planar surface is oriented at a first effective backrake angle measured between the cutter supporting surface and a surface vector of the first planar surface;

wherein the second cutter element has a central axis and comprises:

a second forward-facing cutting face including a second cutting tip distal the cutter supporting surface and a second planar surface extending radially from the second cutting tip toward the central axis of the second cutter element;

wherein the second planar surface is oriented at a second effective backrake angle measured between the cutter supporting surface and a surface vector of the second planar surface;

wherein the second effective backrake angle is greater than the first effective backrake angle;

wherein the first cutting face is non-planar and comprises a plurality of planar surfaces that intersect at distinct edges, wherein the plurality of planar surfaces include the first planar surface; and wherein the second cutting face is non-planar and comprises a plurality of planar surfaces that intersect at distinct edges, wherein the plurality of planar surfaces include the second planar surface.

17. The drill bit of claim 16, wherein the second effective backrake angle is up to 20° greater than the first effective backrake angle.

18. The drill bit of claim 17, wherein the second effective backrake angle is 5° to 15° greater than the first effective backrake angle.

19. The drill bit of claim 16, wherein the first cutter element is radially adjacent the second cutter element on the blade.

20. The drill bit of claim 16, wherein the bit body includes a cone region, a shoulder region, and a gage region, wherein the second cutter element is positioned in the cone region.

21. The drill bit of claim 16, wherein the blade is a primary blade that extends radially outward from proximal the central axis of the drill bit.

22. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a first blade extending radially along the bit face;

a second blade extending radially along the bit face and circumferentially-spaced from the first blade;

a first cutter element mounted to a cutter-supporting surface of the first blade and a second cutter element mounted to a cutter-supporting surface of the second blade;

wherein the first cutter element has a central axis and comprises:

a first forward-facing cutting face including a first cutting tip distal the cutter supporting surface of the first blade and a first planar surface extending radially from the first cutting ti toward the central axis of the first cutter element;

wherein the first planar surface is oriented at a first effective backrake angle measured between the cutter supporting surface of the first blade and a surface vector of the first planar surface;

wherein the second cutter element has a central axis and comprises:

a second forward-facing cutting face including a second cutting tip distal the cutter supporting surface of the second blade and a second planar surface extending radially from the second cutting tip toward the central axis of the second cutter element;

wherein the second planar surface is oriented at a second effective backrake angle measured between the cutter supporting surface of the second blade and a surface vector of the second planar surface;

wherein the second effective backrake angle is greater than the first effective backrake angle;

wherein the first cutting face is completely planar and defined by the first planar surface, and wherein the first cutter element is oriented at a first backrake angle measured between the central axis of the first cutter element and the cutter-supporting surface of the first blade, and wherein the first effective backrake angle is the same as the first backrake angle;

wherein the second cutting face is non-planar and comprises a plurality of planar surfaces that intersect at distinct edges, wherein the plurality of planar surfaces include the second planar surface.

23. The drill bit of claim 22, wherein the second effective backrake angle is up to 20° greater than the first effective backrake angle.

24. The drill bit of claim 23, wherein the second effective backrake angle is 5° to 15° greater than the first effective backrake angle.

25. The drill bit of claim 22, wherein the first cutter element has a first radial position relative to the central axis of the drill bit and the second cutter element has a second radial position relative to the central axis of the drill bit, wherein the second radial position is sequentially adjacent the first radial position.

26. The drill bit of claim 22, wherein the bit body includes a cone region, a shoulder region, and a gage region, wherein the first cutter element and the second cutter element are positioned in the cone region.

27. The drill bit of claim 22, wherein the first blade is a primary blade that extends radially outward from proximal the central axis of the drill bit.

28. The drill bit of claim 22, wherein each backrake angle ranges from 10° to 25°.

29. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a first blade extending radially along the bit face;

a second blade extending radially along the bit face and circumferentially-spaced from the first blade;

a first cutter element mounted to a cutter-supporting surface of the first blade and a second cutter element mounted to a cutter-supporting surface of the second blade;

wherein the first cutter element has a central axis and comprises:

a first forward-facing cutting face including a first cutting tip distal the cutter supporting surface of the first blade and a first planar surface extending radially from the first cutting tip toward the central axis of the first cutter element;

wherein the first planar surface is oriented at a first effective backrake angle measured between the cutter supporting surface of the first blade and a surface vector of the first planar surface;

wherein the second cutter element has a central axis and comprises:

a second forward-facing cutting face including a second cutting tip distal the cutter supporting surface of the second blade and a second planar surface extending radially from the second cutting tip toward the central axis of the second cutter element;

wherein the second planar surface is oriented at a second effective backrake angle measured between the cutter supporting surface of the second blade and a surface vector of the second planar surface;

wherein the second effective backrake angle is greater than the first effective backrake angle;

wherein the first cutter element is oriented at a first backrake angle measured between the central axis of the first cutter element and the cutter-supporting surface, wherein the second cutter element is oriented at a second backrake angle measured between the central axis of the second cutter element and the cutter-supporting surface, wherein the first backrake angle is the same as the second backrake angle.

30. The drill bit of claim 29, wherein the first cutting face is completely planar and defined by the first planar surface, and wherein the first cutter element is oriented at a first backrake angle measured between the central axis of the first cutter element and the cutter-supporting surface of the first blade, and wherein the first effective backrake angle is the same as the first backrake angle.

31. The drill bit of claim 29, wherein each backrake angle ranges from 10° to 25°.

32. The drill bit of claim 29, wherein the second effective backrake angle is up to 20° greater than the first effective backrake angle.

33. The drill bit of claim 32, wherein the second effective backrake angle is 5° to 15° greater than the first effective backrake angle.

34. The drill bit of claim 29, wherein the first cutter element has a first radial position relative to the central axis of the drill bit and the second cutter element has a second radial position relative to the central axis of the drill bit, wherein the second radial position is sequentially adjacent the first radial position.

35. The drill bit of claim 29, wherein the bit body includes a cone region, a shoulder region, and a gage region, wherein the first cutter element and the second cutter element are positioned in the cone region.

36. The drill bit of claim 29, wherein the first blade is a primary blade that extends radially outward from proximal the central axis of the drill bit.

37. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a first blade extending radially along the bit face;

a second blade extending radially along the bit face and circumferentially-spaced from the first blade;

a first cutter element mounted to a cutter-supporting surface of the first blade and a second cutter element mounted to a cutter-supporting surface of the second blade;

wherein the first cutter element has a central axis and comprises:

a first forward-facing cutting face including a first cutting tip distal the cutter supporting surface of the first blade and a first planar surface extending radially from the first cutting tip toward the central axis of the first cutter element;

wherein the first planar surface is oriented at a first effective backrake angle measured between the cutter supporting surface of the first blade and a surface vector of the first planar surface;

wherein the second cutter element has a central axis and comprises:

a second forward-facing cutting face including a second cutting tip distal the cutter supporting surface of the second blade and a second planar surface extending radially from the second cutting tip toward the central axis of the second cutter element;

wherein the second planar surface is oriented at a second effective backrake angle measured between the cutter supporting surface of the second blade and a surface vector of the second planar surface;

wherein the second effective backrake angle is greater than the first effective backrake angle;

wherein the first cutting face is non-planar and comprises a plurality of planar surfaces that intersect at distinct edges, wherein the plurality of planar surfaces include the first planar surface; and wherein the second cutting face is non-planar and comprises a plurality of planar surfaces that intersect at distinct edges, wherein the plurality of planar surfaces include the second planar surface.

38. The drill bit of claim 37, wherein each backrake angle ranges from 10° to 25°.

39. The drill bit of claim 37, wherein the second effective backrake angle is up to 20° greater than the first effective backrake angle.

40. The drill bit of claim 39, wherein the second effective backrake angle is 5° to 15° greater than the first effective backrake angle.

41. The drill bit of claim 37, wherein the first cutter element has a first radial position relative to the central axis of the drill bit and the second cutter element has a second radial position relative to the central axis of the drill bit, wherein the second radial position is sequentially adjacent the first radial position.

42. The drill bit of claim 7, wherein the bit body includes a cone region, a shoulder region, and a gage region, wherein the first cutter element and the second cutter element are positioned in the cone region.

43. The drill bit of claim 37, wherein the first blade is a primary blade that extends radially outward from proximal the central axis of the drill bit.

* * * * *